US006844129B2

(12) United States Patent
Ito

(10) Patent No.: US 6,844,129 B2
(45) Date of Patent: Jan. 18, 2005

(54) HEAT-DEVELOPABLE PHOTOSENSITIVE MATERIAL, AND METHOD OF PRODUCING THE SAME

(75) Inventor: Yoshimitsu Ito, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 157 days.

(21) Appl. No.: 10/255,954

(22) Filed: Sep. 27, 2002

(65) Prior Publication Data

US 2003/0099898 A1 May 29, 2003

(30) Foreign Application Priority Data

Sep. 28, 2001 (JP) ..... 2001-302132

(51) Int. Cl.[7] ..... G03C 11/12; G03C 1/498

(52) U.S. Cl. ..... 430/256; 430/619; 430/935

(58) Field of Search ..... 430/256, 617, 430/619, 935, 938

(56) References Cited

U.S. PATENT DOCUMENTS 6,110,659 A * 8/2000 Hatakeyama et al. ..... 430/617

* cited by examiner

*Primary Examiner*—Thorl Chea
(74) *Attorney, Agent, or Firm*—Birch, Stewart, Kolasch & Birch, LLP

(57) ABSTRACT

The present invention provides a heat-developable photosensitive material having a substrate, an undercoat layer and photosensitive layer containing silver behenate in this order, wherein an adhesive roll having an adhesive force of at least 35 hPa is brought into contact with one face or both faces of the photosensitive material before the photosensitive layer is formed, and a method of producing the same.

5 Claims, No Drawings

HEAT-DEVELOPABLE PHOTOSENSITIVE MATERIAL, AND METHOD OF PRODUCING THE SAME

This nonprovisional application claims priority under 35 U.S.C. § 119(a) on Patent Application No. 2001-302132 filed in Japan on Sep. 28, 2001, which is herein incorporated by reference.

BACKGROUND OF THE INVENTION

1. Field of the Invention

The present invention relates to a heat-developable photosensitive material, which may be referred to as a "photosensitive material" hereinafter, used suitably for medical diagnosis, industrial photography, printing and COM; and a method of producing the same.

2. Description of the Related Art

In recent years, it has been intensely demanded to reduce processing liquid waste from the viewpoint of environmental preservation and saving space in the fields of films for medical diagnosis and films for photographic plate-making. Thus, technique on heat-developable photosensitive materials is necessary as films for medical diagnosis and films for photoengraving which make it possible to form distinct black images having high resolution and sharpness. According to these heat-developable photosensitive materials, it is possible to supply to customers a simpler heat-developable processing system which does not require any processing chemical agent which is a solution or damage environment.

Similar matters are also demanded in the fields of ordinary image forming materials. Particularly in the field of films for medical diagnosis, a high image-quality, which is superior in sharpness and graininess, is necessary since delicate depiction is required. Moreover, diagnosis is required to be easily attained. From these viewpoints, an image having a cool tone is preferred. At present, various hard copy systems using pigment or dye, such as an inkjet printer and electrophotography, are in circulation as ordinary image forming systems. However, no hard copy system is satisfactory as an output system for medical images. Thermal image forming systems using an organic silver salt are described in, for example, U.S. Pat. Nos. 3,152,904 and 3,457,075, and "Thermally Processed Silver Systems" (Imaging Processes and Materials, Neblette $8^{th}$ version, written by D. Klosterboer and edited by J. Sturge, V. Walworth, and A. Shepp, Chap. 9, p. 279, 1989). In particular a heat-developable photosensitive material in general has a photosensitive layer wherein a catalyst-activating amount of a photocatalyst (for example, silver halide), a reducing agent, a reducible silver salt (for example, an organic silver salt), and optionally, a color adjusting agent for controlling a color tone of silver are dispersed in a matrix of a binder. The heat-developable photosensitive material is imagewise exposed to light, heated to a high temperature (for example, 80° C.) to cause redox reaction between the reducible silver salt (functioning as an oxidizer) and the reducing agent, thereby forming a black silver image. The redox reaction is promoted by catalytic action of a latent image of the silver halide generated by the exposure. Therefore, the black silver image is formed in the exposed area. Fuji Medical Dry Imager FM-DP L, which is disclosed in a great number of documents, examples of which include U.S. Pat. No. 2,910,377 and Japanese Patent Application Publication No. 43-4924, has been sold as a system for forming medical images.

In the production process of the heat-developable photosensitive material, a photosensitive layer is formed on a substrate. An undercoat layer is usually deposited on the substrate in order to raise the adhesion between the substrate and the photosensitive layer. Moreover, in the production process, foreign matters such as dust, dirt and fragments of the coating-film are easily generated. These result in various problems. One of them is a problem that if foreign matters such as dust, dirt and fragments of the coating-film are present on the substrate at the time of forming the undercoat layer, troubles such as a repellence defect and a streaking defect, resulting from these foreign matters, happen in the undercoat layer and thus a bad effect is also produced in the photosensitive layer formed thereon, so that a defect is generated in the heat-developable photosensitive material itself. Similarly, if the undercoat layer is formed and subsequently a foreign matter is present on the layer, the following problem arises: a bad effect is also produced in the photosensitive layer, so that a defect is generated in the heat-developable photosensitive material itself.

Particularly in the case in which the photosensitive layer contains silver behenate, the photosensitive layer is brittle and is affected by the state of the undercoat layer. Therefore, there is a problem that the above-mentioned defects are markedly generated. For photosensitive materials required to have a high image quality, for example, photosensitive materials for medical diagnosis, this problem is serious. Thus, it is intensely demanded to solve this problem.

SUMMARY OF THE INVENTION

In the light of the above-mentioned problem in the prior art, the present invention has been made. An object of the invention is to provide a heat-developable photosensitive material wherein a photosensitive layer containing silver behenate is satisfactorily formed, and a method of producing the same.

A first aspect of the invention is a heat-developable photosensitive material comprising a substrate, an undercoat layer and a photosensitive layer containing silver behenate in this order, wherein an adhesive roll having an adhesive force of at least 35 hPa is brought into contact with one face or both faces of the photosensitive material before the photosensitive layer is formed.

A second aspect of the invention is to provide a method of producing a heat-developable photosensitive material that includes a substrate and an undercoat layer and a photosensitive layer containing silver behenate disposed on the substrate in this order, the method comprising the steps of: contacting an adhesive roll having an adhesive force of at least 35 hPa with one face or both faces of the photosensitive material before forming the photosensitive layer.

DETAILED DESCRIPTION OF THE PREFERRED EMBODIMENT

The present invention will be described in detail hereinafter. The method of producing the heat-developable photosensitive material of the invention will also be described together with the heat-developable photosensitive material of the invention.

The heat-developable photosensitive material of the invention comprises a substrate, an undercoat layer and a photosensitive layer containing silver behenate in this order, wherein an adhesive roll having an adhesive force of at least 35 hPa is brought into contact with one face or both faces of the photosensitive material before the photosensitive layer is formed.

In the invention, the time before the formation of the photosensitive layer at which the adhesive roll is brought into contact with the photosensitive material is, for example, the time before the formation of the undercoat layer and/or the time after the formation of the undercoat layer. By bringing the adhesive roll having an adhesive force of 35 hPa or more into contact with one face or both faces of the incomplete photosensitive material, that is, one face or both faces of the substrate before the formation of the undercoat layer, foreign matters such as dust, dirt and fragments of the coating-film, which are adhering to the face(s) of the substrate, are removed. As a result, a satisfactory undercoat layer is formed without defects such as a cissing defect and a streaking defect caused by foreign matters. By bringing the adhesive roll having an adhesive force of 35 hPa or more into contact with one face or both faces of the incomplete photosensitive material, that is, the surface of the undercoat layer, the face of the substrate opposite to the face on which the undercoat layer is formed, or both faces after the formation of the undercoat layer, foreign matters such as dust, dirt and fragments of the coating-film, on the undercoat layer, are removed. Therefore, the photosensitive layer containing silver behenate, which is strongly affected by the state of the undercoat layer, is satisfactorily formed.

First, the adhesive roll will be described.

The adhesive roll has an adhesive force of 35 hPa or more. If this adhesive force is less than 35 hPa, dust and dirt adhering onto the substrate or the undercoat layer formed on the substrate cannot be sufficiently removed and a cissing defect (meaning a concave made by making the undercoat layer uneven (not flat) due to the adhesion of the dust and the dirt onto the undercoat layer), a black point defect and a streaking defect are generated frequently. As a result, a good photosensitive layer cannot be formed. On the other hand, if the adhesive force is more than 200 hPa, wrinkles are easily generated in the substrate or the formed undercoat layer, so that a good photosensitive layer may not be formed.

The adhesive roll preferably has a surface hardness of 30° or less in view of the balance between the adhesive force and the hardness. If the surface hardness is more than 30°, the contact area becomes small, so that a capability of removing the foreign matters may be lowered. On the other hand, if the surface hardness is too small, wrinkles are easily generated in the substrate and the formed undercoat layer, so that a good photosensitive layer may not be formed.

As the adhesive roll, there may be used a known adhesive roll for removing dirt and dust, for example, a roll whose surface is made of urethane rubber, silicone rubber or butyl rubber. The material of the roll surface of this adhesive roll can be selected at will based on the materials of the substrate, the undercoat layer and the foreign matters. The diameter of the adhesive roll is not particularly limited, and is preferably within the range of about 1.0 to 10 cm. The width thereof is preferably selected in accordance with the width of the photosensitive material.

In the invention, while a long substrate sheet is conveyed, a coating solution for an undercoat layer is usually applied onto the substrate and dried so as to form the undercoat layer. While the long substrate sheet on which the undercoat layer is formed is conveyed, a coating solution for a photosensitive layer is further applied onto the undercoat layer and dried to form the photosensitive layer. Thereafter, the resultant is cut into materials having an arbitrary size. Before the coating and drying of the coating solution for the undercoat layer, and/or before the formation of the photosensitive layer, the adhesive roll is brought into contact with the substrate or the undercoat layer surface. Usually, the substrate sheet on which the undercoat layer is formed is once wounded into a roll form. In order to prevent re-adhesion of foreign matters, it is preferable that immediately before the winding, the adhesive roll is brought into contact with the substrate or undercoat layer surface. The adhesive roll may be driven with the conveyance of the substrate or the substrate on which the undercoat layer is formed, or may be made as a free roll. The contact speed of the adhesive roll is preferably from 30 to 200 m/min. This contact speed means the conveyance speed of the substrate or the substrate on which the undercoat layer is formed, i.e., the so-called line speed. If this speed is less than 30 m/min., production efficiency may lower. On the other hand, if the speed is more than 200 m/min., a foreign matter removing capability of the adhesive roll may drop.

In the invention, the adhesive roll is brought into contact with the photosensitive material (the substrate, or the substrate on which the undercoat layer is formed) to remove foreign matters. The contact angle between the adhesive roll and the photosensitive material at this time is preferably from 0 to 120°, more preferably from 30 to 100°.

This contact angle (lap angle) is a central angle of arc formed by one end and the other end of a portion where the photosensitive material contacts the adhesive roll when the adhesive roll is viewed from its central axis direction.

In the invention, the tension (tensile strength applied to the photosensitive material when conveyed) of the photosensitive material (the substrate or the substrate on which the undercoat layer is formed) with which the adhesive roll is brought into contact is preferably from 10 to 140 kgf/width, and more preferably from 30 to 80 kgf/width.

When the adhesive roll is brought into contact with the photosensitive material (the substrate or the substrate on which the undercoat layer is formed) in the invention, an atmosphere having a temperature of 10 to 60° C. and a humidity of 30 to 90% is preferable and an atmosphere having a temperature of 20 to 40° C. and a humidity of 40 to 70% is more preferable in order to remove foreign matter satisfactorily.

When the adhesive roll is brought into contact with the photosensitive material (the substrate or the substrate on which the undercoat layer is formed), an atmosphere having a cleanliness class of M5.5 or less is preferable in order to prevent re-adhesion of foreign matters.

The cleanliness class is a standard about the cleanliness stipulated in FED-STD-209E, and is the following value: when the number, per $m^3$, of floating particles which are present in an atmosphere and have a particle diameter of 0.5 $\mu$m or more, is represented by $10^x$, the cleanliness class is the value of X. Since the cleanliness class is based on the metric system, the class is represented by M(X).

The cleanliness can also be represented as a value based on feet (FED-STD-209D). M4.5 is converted to class 1000 (that is, the number of floating particles having a particle diameter of 0.5 $\mu$m or more is 1000 per $ft^3$), and M5.5 is converted to class 10000 (that is, the number of floating particles having a particle diameter of 0.5 $\mu$m or more is 10000 per $ft^3$ (10000/CFM)).

A dust and dirt measuring device (made by in Hiack/Leuco in USA) exclusive for a clean room is used to count, through a semiconductor laser, particles in a specified amount (1 $ft^3$) of absorbed air separately for each size, and on the basis of the results the cleanliness class is represented according to the FED-STD.

In order to remove static electricity (for example, peel electrification when the adhesive roll is peeled from the photosensitive material) generated when the adhesive roll is brought into contact with the photosensitive material (the substrate or the substrate on which the undercoat layer is formed) or when the photosensitive material is conveyed, it is preferable to conduct electricity-removing treatment in the invention. The electricity-removing treatment is preferably conducted immediately after the adhesive roll is brought into contact with the photosensitive material.

In the case in which the adhesive roll is used for a long time in the invention, foreign matters adhere gradually to the surface of the roll, so that the adhesive performance thereof may deteriorate. In this case, the adhesive roll may be stripped off a machine at a predetermined intervals and then the roll surface may be washed with pure water to restore the adhesive performance, and subsequently the washed adhesive roll may be set in the machine again. In this way, the adhesive roll may be reused. A cleaning roll may be arranged to contact the roll surface of the adhesive roll. In this case, dust or dirt adhering to the surface of the adhesive roll is caused to adhere to the cleaning roll, whereby the adhesive performance of the adhesive roll can be constantly kept.

In the invention, a heat-developable photosensitive material can be produced by a conventionally known method using a composition which will be described later except the adhesive roll is used in the manner as mentioned above. The following will describe the respective layers (including the substrate) thereof.

Undercoat Layer

The undercoat layer comprises, as a binder resin, a resin dispersible in water, for example, an acrylic resin, a polyester resin, a polyurethane resin, a polystyrene resin, an SBR resin, a PVDC resin, or the like. The resin has a high water-resistance, and is good in adhesion to a polyester film or the like.

If necessary, a polymer other than the binder resin may be incorporated into the binder resin in the undercoat layer. Examples of the polymer include water-soluble polymers such as gelatin, and polyvinyl alcohol; and hydrophobic polymers such as polyvinylidene chloride and polyurethane. These polymers are used without any limitation.

If necessary, electroconductive particles, a crosslinking agent, a matting agent, a dye, a filler, a surfactant, a preservative, a pH adjusting agent or the like, besides the binder, may be added to the undercoat layer.

The undercoat layer preferably has a surface resistance (SR) of $10^6$ to $10^{12}$ Ω.cm . By setting the surface resistance of the undercoat layer within the above-mentioned range, an electrostatic trouble at the time of processing is solved, so that fog can be effectively prevented. In order to set the surface resistance within the above-mentioned range, it is preferable to add electroconductive particles to the under coat layer.

Examples of the electroconductive particles include tin oxide, indium oxide, zinc oxide, aluminum oxide, and titanium oxide. Among these, tin oxide doped with antimony is preferable, and antimony-doped electroconductive tin oxide particles having a needle-form structure, wherein the ratio of the long axis to the short axis is within the range of 3 to 50, are particularly preferable. When the electroconductive tin oxide particles are used, the necessary conductivity can be obtained by adding a small amount of these particles. Thus, problems in the undercoat layer such as the photographic image efficiency being reduced or the Dmin being increased because of blue, which is the color of the tin oxide, staining (the color of the surface becoming dull), can be avoided.

A known compound such as epoxy, isocyanate or melamine is used as the crosslinking agent. It is preferable to use an active halogen crosslinking agent described in Japanese Patent Application Laid-Open (JP-A) No. 51-114120 and the like.

In order to improve high-speed conveyance performance in the production, it is preferable to use a matting agent in the undercoat layer . It is preferable to use, as the matting agent, fine particles of styrene, polymethyl methacrylate, or silica having an average particle size of about 0.1 to 8 μm, and preferably about 0.2 to 5 μm. The use amount of the matting agent is preferably from 1 to 200 mg, and more preferably from 2 to 100 mg per $m^2$ of the heat-developable photosensitive material.

Colloidal silica or the like may be used as the filler. An anionic, nonionic or cationic surfactant may be used as the surfactant. A dye for anti-halation, a dye for color tone adjustment or the like may be used as the dye.

The thickness of the undercoat layer is preferably from about 0.05 to 5 μm, and more preferably from about 0.1 to 3 μm.

The undercoat layer may be formed by applying and drying an aqueous or organic-solvent type coating solution for the undercoat layer. From the viewpoints of costs and environmental preservation, it is preferable to use the aqueous coating solution. The "aqueous coating solution" herein means a coating solution containing water in an amount of 30% or more, and preferably 50% by mass or more of the solvent (dispersion medium) of the coating solution.

Specific examples of the composition of the solvent include the following mixed solution: water/methanol=85/15, water/methanol=70/30, water/methanol/dimethylformamide(DMF)=80/15/5, and water/isopropyl alcohol=60/40 (the numbers represent ratios by mass), as well as only water.

The coating method and the drying method of the undercoat layer are not particularly limited if the methods are performed in an atmosphere having a cleanliness class within the above-mentioned range.

A known method such as a bar coater method or a dip coater method may be used as the coating method.

The drying method may be performed at a temperature of about 25 to 200° C. for about 0.5 to 20 minutes. Under this condition, the coating solution can be dried.

The undercoat layer according to the invention may have a mono-layer structure, or two- or more-layer structure.

Photosensitive Layer

The following will describe the photosensitive layer, which may be referred to as an "image-forming layer" hereinafter, in the invention.

The photosensitive layer in the invention contains silver behenate as a non-photosensitive organic silver salt. The photosensitive layer may contain a photosensitive silver halide, other non-photosensitive organic silver salt, a reducing agent for silver ions, and a binder if necessary.

The components contained in the photosensitive layer in the invention will be described hereinafter.

About the photosensitive silver halide, the halogen composition thereof is not particularly limited. Silver chloride, silver chlorobromide, silver bromide, silver iodobromide, or silver iodochlorobromide may be used. Among these, silver bromide and silver iodobromide are preferable. The distribution of the halogen composition in the grains may be even, the halogen composition may be changed step by step, or may be continuously changed. Silver halide grains having a core/shell structure can be preferably used. The structure thereof preferably has any one selected from a double structure to a quintuple structure. More preferably, core/shell grains having any one selected from a double structure to a quadruplet structure are used. It is also preferable to use technique of localizing silver bromide on the surface of silver chloride or silver chorobromide grains.

The method of forming a photosensitive silver halide is well-known in the art. For example, the methods described in the following can be used: Research Disclosure No. 17029 in June, 1978, and U.S. Pat. No. 3,700,458. Specifically, the following method is used: a photosensitive silver halide is prepared by adding a silver-supplying compound and a halogen-supplying compound to a solution of gelatin or another polymer, and subsequently the solution is mixed with an organic silver salt. Preferable are also methods described in paragraphs 0217 to 0224 in JP-A No. 11-119374, and Japanese Patent Application Nos. 11-98708 and 2000-42336.

In order to suppress cloudiness after the formation of an image, the grain size of the photosensitive silver halide is preferably small and is specifically 0.20 $\mu$m or less, more preferably from 0.01 $\mu$m to 0.15 $\mu$m, and most preferably from 0.02 to 0.12. The grain size herein means a diameter of a circular image having an area equivalent to the projected area of the silver halide grain (the projected area of the main plane in the case of tabular grains).

Examples of the form of the silver halide grain include cubic, octahedral, tabular, spherical, rod-like and potato-like grains. In the invention, cubic grains are particularly preferable. Silver halide grains whose corners are round can be preferably used. The plane index (Miller index) of the outer surface of the photosensitive silver halide grains is not particularly limited, and it is preferable that the ratio of the {100} plane, which has a high spectrally-sensitizing efficiency when a spectrally sensitizing dye is adsorbed to the plane, to any kind of planes which the silver halide grain may have is high. The ratio is preferably 50% or more, more preferably 65% or more, and further preferably 80% or more. The ratio of the Miller index {100} plane can be obtained by a method described in "J. Imaging Sci., 29, 165 (1985)" by Tani, using adsorption dependency of {111} and {100} planes in adsorption of sensitizing dyes.

In the invention, silver halide grains containing a hexacyano metal complex in their outermost surfaces are preferable. Examples of the hexacyano metal complex include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, hexacyano iron complexes are preferable.

Since the hexacyano metal complex is present in the form of an ion in an aqueous solution, a counter cation is not important, but any one selected from the following ions, which are easily miscible with water and suitable for precipitation operation of an silver halide emulsion, is preferably used as the counter cation: alkali metal ions (such as sodium, potassium, rubidium, cesium, and lithium ions), an ammonium ion, and alkyl ammonium ions (such as tetramethyl ammonium, tetraethyl ammonium, tetrapropyl ammonium and tetra(n-butyl)ammonium ions).

The hexacyano metal complex may be added in the form of a mixture of the complex and water or a suitable solvent which is miscible with water (for example, alcohols, ethers, glycols, ketones, esters and amides), or added with gelatin.

The adding amount of the hexacyano metal complex is preferably from $1\times10^{-5}$ to $1\times10^{-2}$ moles, more preferably from $1\times10^{-4}$ to $1\times10^{-3}$ moles per mole of silver.

In order to cause the hexacyano metal complex to be present in the outermost surface of the silver halide grains, the hexacyano metal complex is directly added after the addition of an aqueous solution of silver nitrate, which is used for the formation of the grains, and before the end of a charging step before a chemical sensitization step of performing calcogen sensitization, such as sulfur sensitization, selenium sensitization or tellurium sensitization, or noble metal sensitization, such as gold sensitization, or is directly added in a water-washing step, in a dispersing step, or before the chemically sensitizing step. In order to prevent the silver halide fine grains from growing, it is preferable to add the hexacyano metal complex rapidly after the formation of the grains and before the end of the charging step.

The addition of the hexacyano metal complex may be started after 96% by mass of the total amount of silver nitrate, which is added to form the grains, is added. The addition is preferably started after 98% by mass thereof is added, and is more preferably started after 99% by mass thereof is added.

If the hexacyano metal complex is added after the addition of the aqueous solution of silver nitrate is added (that is, immediately before the completion of the formation of the grains), the complex can be adsorbed on the outermost surface of the silver halide grains, and almost all thereof bonds to silver ions on the surfaces of the grains to form a slightly soluble salt. Since the silver salt of the hexacyano iron (II) is a salt which is a less soluble salt than AgI, re-dissolution of the fine grains can be prevented. Thus, silver halide fine grains having a small grain size can be produced.

The photosensitive silver halide grains in the invention can contain a metal of the VIII group to the X group in the periodic table (indicating the I group to XVIII group), or a complex of the metal. The metal of the VIII group to the X group in the periodic table or the central metal of the metal complex is preferably rhodium, ruthenium, or iridium. One kind of the metal complex may be used, or two or more kinds of the complexes of the same metal or different metals may be used. A content of the metal or the metal complex is preferably within the range of $1\times10^{-9}$ to $1\times10^{-3}$ mole per mole of silver. The heavy metals, the metal complexes and the method of the addition thereof are described in JP-A No. 7-225449, paragraphs 0018 to 0024 of JP-A No. 11-65021, and paragraphs 0227 to 0240 of JP-A No. 11-119374.

The metal atoms which can be contained in the silver halide grains used in the invention (for example, $[Fe(CN)_6]^{4-}$)), the method of desalting a silver halide emulsion, and the method of chemically sensitizing the emulsion are described in paragraphs 0046 to 0050 of JP-A No. 11-84574, paragraphs 0025 to 0031 of JP-A No. 11-65021, and paragraphs 0242 to 0250 of JP-A No. 11-119374.

The gelatin contained in the photosensitive silver halide emulsion used in the invention may be any one selected from various gelatins. In order to keep the dispersion state of the photosensitive silver halide emulsion in the organic silver salt-containing coating solution good, it is preferable to use a low molecular weight gelatin having a molecular weight of 500 to 60,000. The low molecular weight gelatin may be used at the time of the formation of the grains, or the dispersion thereof after desalting treatment. Preferably, the low molecular weight gelatin may be used at the time of the dispersion after desalting treatment.

A sensitizing dye which can be used in the invention can be profitably selected from sensitizing dyes that can spectrally sensitize silver halide grains in a desired wavelength range when the dyes are absorbed on the silver halide grains, and that have a spectral sensitivity suitable for the spectral property of a light source for exposure. The sensitizing dyes and the method of the addition thereof are described in paragraphs 0103 to 0109 of JP-A No. 11-65021, JP-A Nos.10-186572 (compounds represented by the general formula (II)), and 11-119374 (dyes represented by the general formula (I), and paragraphs 0106), U.S. Pat. Nos. 5,510,236 and 3,871,887 (dyes described in Example 5), JP-A Nos. 2-96131 (dyes)and 59-48753 (dyes), EP No. 0803764A1 (page 19, line 38 to page 20, line 35), Japanese Patent Application Nos. 2000-86865, 2000-102560 and 2000-205399, and the like. These sensitizing dyes may be used alone or in combination of two or more. The timing when the sensitizing dye is added to the silver halide emulsion in the invention is preferably after the desalting step and before the step of applying the emulsion, and is more preferably after the desalting step and before the start of chemical ripening.

The adding amount of the sensitizing dye in the invention may be selected in accordance with sensitivity and performance against fog. The amount is preferably from $10^{-6}$ to 1 mole, and more preferably from $10^{-4}$ to $10^{-1}$ mole per mole of silver halide in the photosensitive layer.

In order to improve the spectrally-sensitizing efficiency in the invention, a supersensitizer may be used. Examples of the supersensitizer used in the invention include compounds described in EP No. 587,338A. U.S. Pat. Nos. 3,877,943 and 4,873,184, JP-A Nos. 5-341432, 11-109547, 10-111543, and the like.

The photosensitive silver halide grains are preferably subjected to chemical sensitization by a sulfur sensitizing method, a selenium sensitizing method or a tellurium sensitizing method. A compound which is preferably used in the sulfur sensitizing method, the selenium sensitizing method or the tellurium sensitizing method may be a known compound, such as any one of compounds described in JP-A No. 7-128768. In the invention, the tellurium sensitization is particularly preferable. Compounds described in paragraph 0030 of JP-A No. 11-65021, and compounds represented by the general formulae (II), (III), and (IV) in JP-A No. 5-313284 are more preferable.

In the invention, chemical sensitization may be performed at any time after the formation of the grains and before the coating with the emulsion, for example, after the desalting step and (1) before the spectral sensitization, (2) at the same time when the spectral sensitization is performed, and (3) after the spectral sensitization, (4) immediately before the coating of the emulsion. The chemical sensitization is preferably performed after the spectral sensitization.

The amount of the sulfur, selenium or tellurium sensitizer used in the invention varies dependently on the used silver halide grains, chemically ripening conditions, and the like. The amount is from about $10^{-8}$ to $10^{-2}$ mole, and preferably from about $10^{-7}$ to $10^{-3}$ mole per mole of silver halide. Conditions for the chemical sensitization in the invention are not particularly limited, but pH is from 5 to 8, pAg is from 6 to 11, and temperature is from about 40 to 95° C.

A thiosulfonic acid compound may be added to the silver halide emulsion used in the invention by a method described in EP No. 293,917A.

The photosensitive silver halide emulsions in the photosensitive material used in the invention may be used alone or in combination of two or more (for example, emulsions having different average grain sizes, emulsions having different halogen compositions, emulsions having different crystal habits, and emulsions subjected to chemical sensitizations under different conditions). Two or more photosensitive silver halides having different sensitivities are used to make it possible to adjust color tones. Examples of the technique thereon are disclosed in JP-A Nos. 57-119341, 53-106125,47-3929, 48-55730,46-5187, 50-73627, and 57-150841. It is preferable to cause the emulsions to have a sensitivity difference of 0.2 logE or more between them.

The adding amount of the photosensitive silver halide is preferably from 0.3 to 0.6 g/$m^2$, more preferably from 0.04 to 0.4 g/$m^2$, and most preferably from 0.05 to 0.3 g/$m^2$, based on the weight of coated silver per $m^2$ of the photosensitive material. The amount of the photosensitive silver halide is preferably from 0.01 to 0.5 mole, and more preferably from 0.02 to 0.3 mole per mole of the organic silver salt.

Examples of the method of mixing the photosensitive silver halide and the organic silver salt which are separately prepared and conditions for the mixing include a method of mixing the silver halide grains and the organic silver salt, each of which has already been prepared, with a high-speed stirrer, a ball mill, a sand mill, a colloid mill, a vibration mill, a homogenizer, or the like; and a method of mixing the organic silver salt with the photosensitive silver halide, which has already been prepared, at any timing during the time when the organic salt is being prepared, so as to prepare the organic silver salt. If the effect of the invention is sufficiently produced, the method to be used is not limited. In order to adjust photographic properties, it is preferable to mix two or more organic silver salt aqueous dispersions and two or more photosensitive silver salt aqueous dispersions at the time of the mixing.

In the invention, a preferable time to add the silver halide to the image forming layer coating solution is from 180 minutes before coating with the solution to immediately before the coating, and preferably from 60 minutes to 10 seconds before the coating. The method of mixing the silver halide with the solution and conditions for the mixing are not particularly limited if the effect of the invention is sufficiently produced. Specific examples of the mixing method include a method of mixing them in a tank wherein an average residence time, which is calculated from an addition flow rate and an amount of a solution sent to a coater, is set to a desired time, and a mixing method which uses a static mixer, described in Chapter 8 of "Liquid Mixing Technique" (published by Nikkan Kogyo Shimbun, Ltd. in 1989) written by N. Harnby, M. F. Edwards and A. W. Nienow, and translated by Koji Takahashi.

The photosensitive layer according to the invention contains silver behenate as a non-photosensitive organic silver salt, and can contain, if necessary, other non-photosensitive organic silver salt.

The non-photosensitive organic silver salt that can be used in the invention, which may be referred to merely as the "organic silver salt" hereinafter, is a silver salt which is relatively stable against light and which produces a silver image when it is heated to 80° C. or more in the presence of an exposed photocatalyst (such as a latent image of the photosensitive silver halide) and a reducing agent. The organic silver salt may be any organic material containing a source capable of reducing silver ions. Such a non-photosensitive organic silver salt is described in JP-A Nos. 06-130543, 08-314078, 09-127643, 10-62899 (paragraphs 0048 to 0049), 10-94074,and 10-94075, EP Nos.0803764A1 (page 18, line 24 to page 19, line 37), 0962812A and 1004930A2, JP-A Nos. 11-349591, 2000-7683, 2000-72711, 2000-112057, 2000-155383, and the like. Preferable is a silver salt of an organic acid, and particularly preferable is a silver salt of a long-chain aliphatic carboxylic acid (having 10 to 30 carbon atoms, and preferably 15 to 28 carbon atoms). Preferable examples of the organic silver salt include silver behenate, silver arachidate, silver stearate, silver oleate, silver laurate, silver caprate, silver myristate, silver palmitate, and mixtures thereof. The photosensitive layer according to the invention contains silver behenate, and it is preferable to use an organic acid silver whose silver behenate content is 75 mole % or more.

The shape of the organic silver salt which can be used in the invention is not particularly limited, and may be a needle shape, a rod shape, a tabular shape or a scaly shape.

In the invention, a scaly organic silver salt is preferable. In the present specification, the scaly organic silver salt is defined as follows. An organic silver salt is observed with an electron microscope, and the shape of the organic silver salt grain is approximated to a rectangular parallelepiped. When the sides of the rectangular parallelepiped are represented in order from the shortest side by a, b and c (c may be equal to b), the values a and b, which are the shortest and the second shortest, respectively, are used to calculate x as follows.

$$X=b/a$$

In this way, x is calculated for each of about 200 grains. When the average value thereof is represented by x (average), the grains satisfying the relationship of x (average)$\geqq$1.5 are defined as scaly grains. Preferably, 30$\geqq$x (average)$\geqq$1.5, and more preferably 20$\geqq$x (average) $\geqq$2.0. Needle shape grains satisfy 1$\leqq$x (average)<1.5.

In the scaly grain, the value a can be regarded as a thickness of a tabular grain having, as a main plane, a face having sides b and c. The average of a is preferably from 0.01 to 0.23 $\mu$m, and more preferably from 0.1 to 0.20 $\mu$m (inclusive). The average of c/b is preferably from 1 to 6, more preferably from 1.05 to 4, more still preferably from 1.1 to 3, and most preferably from 1.1 to 2.

The grain size distribution of the organic silver salt is preferably a mono-dispersion. The mono-dispersion means a dispersion wherein percentages resulting from values obtained by dividing the standard deviations of lengths of short axes and long axes by the lengths of the short axes and long axes, respectively, are preferably 100% or less, more preferably 80% or less, and most preferably 50% or less. The shape of the organic silver salt can be measured from a transmission electron microscopic image of a dispersion of the organic silver salt. Another method of measuring mono-dispersibility is a method of obtaining the standard deviation of the volume weighted average diameter of the organic silver salt grains, a percentage (variation coefficient) resulting from the value obtained by dividing the standard deviation by the volume weighted average diameter is preferably 100% or less, more preferably 80% or less, and most preferably 50% or less. The variation coefficient can be calculated, for example, from the grain size (volume weighted average diameter) obtained by applying a laser ray to the organic silver salt dispersed in the liquid and obtaining a self-correlation function of scarred light from the salt to a time change in fluctuation.

Known methods may be used as the production of the organic silver salt used in the invention and the method of dispersing the salt. For example, the following may be referred to: JP-A Nos. 08-234358,and 10-62899, EP Nos.0,803,763A1 and 0,962,812A1, JP-A Nos. 11-349591, 2000-7683, 2000-72711, 2000-53682, 2000-75437, 2000-86669, 2000-143578, 2000-178278 and 2000-256254, and Japanese Patent Applications Nos. 11-348228 to 11-348230, 11-203413, 11-115457, 11-180369, 11-297964, 11-157838, 11-202081, 2000-90093, 2000-195621, 2000-191226, 2000-213813, 2000-214155 and 2000-191226.

If the photosensitive silver salt coexists with the organic silver salt at the time of dispersing the organic silver salt, fog increases, so that sensitivity falls markedly. Therefore, it is preferable that the photosensitive silver salt is not substantially contained at the time of the dispersing. In the invention, the amount of the photosensitive silver salt to be dispersed in the aqueous dispersion is 0.1 mole % or less per mole of the organic silver salt in the dispersion. The addition of the photosensitive silver salt is not positively conducted.

When the photosensitive material is produced, the organic silver salt aqueous dispersion is blended with the photosensitive silver salt aqueous dispersion. However, the blend ratio between the organic silver salt and the photosensitive silver slat can be selected in accordance with a purpose. The ratio of the photosensitive silver salt to the organic silver salt is preferably within the range of 1 to 30% by mole, more preferably within the range of 3 to 20% by mole, and most preferably within the range of 5 to 15% by mole. It is preferable to blend two or more organic silver salt aqueous dispersions with two or more photosensitive silver salt aqueous dispersions in order to adjust photographic properties.

The organic silver salt of the invention may be used in a desired amount. The amount of silver is preferably from 0.1 to 5 g/m$^2$, and more preferably from 1 to 3 g/m$^2$.

The heat-developable photosensitive material of the invention preferably contains a reducing agent for the organic silver salt. The reducing agent for the organic silver salt may be any material (preferably an organic material) capable of reducing a silver ion to metal silver. Such a reducing agent is described in JP-A No. 11-65021 (paragraphs 0043 to 0045) and EP No. 0,803,764A1 (page 7, line 34 to page 18, line 12).

In the invention, preferable examples of the reducing agent include hindered phenol reducing agents, and bisphenol reducing agents. Compounds represented by the general formula (I), which are described in Japanese Patent Application No. 2000-358846, are more preferable.

Specific examples of the reducing agent preferably used in the invention include reducing agents described in Japanese Patent Application No. 2000-358846.

The adding amount of the reducing agent in the invention is preferably from 0.01 to 5.0 g/m$^2$, and more preferably from 0.1 to 3.0 g/m$^2$. Preferably, 5 to 50% by mole of the reducing agent is contained per mole of silver in the face having the photosensitive layer, and more preferably 10 to 40% by mole of the agent is contained per mole of the silver. The reducing agent is preferably contained in the image forming layer.

The reducing agent may be incorporated into the coating solution in any form, such as a solution, an emulsion, or a solid fine grain dispersion, so as to be incorporated into the photosensitive material.

A well-known emulsification method is that in which the reducing agent is dissolved in an oil such as dibutyl phthalate, tricresyl phosphate, glyceryl triacetate or diethyl phthalate, or a co-solvent such as ethyl acetate or cyclohexanone, and an emulsion is produced mechanically.

Examples of the solid fine grain dispersing method include a method of dispersing powder of the reducing agent in a suitable solvent such as water with a ball mill, a colloid mill, a vibration mill, a sand mill, a jet mill or a roller mill, or by ultrasonic waves, so as to produce a solid dispersion. At this time, a protective colloid (for example, polyvinyl alcohol), and/or a surfactant (for example, an anionic surfactant such as sodium triisopropylnaphthalenesulfonate (a mixture of the compounds having three isopropyl groups at different substitution positions)) can be used. A preservative (for example, a sodium salt of benzoisothiazolinone) may be incorporated into the aqueous dispersion.

In the heat-developable photosensitive material of the invention, a phenol derivative represented by the formula (A) described in Japanese Patent Application No. 11-73951 is preferably used as a development accelerator.

In the case in which the reducing agent used in the invention has an aromatic hydroxyl group (—OH), particularly in the case of any one of the above-mentioned bisphenols, it is preferable to use, together with the reducing agent, a non-reducing compound having a group which can form a hydrogen bond with the hydroxyl group. Examples of the group which forms a hydrogen bond with the hydroxyl group or an amino group include phospholyl, sulfoxide, sulfonyl, carbonyl, amide, ester, urethane, ureido, tertiary amino, and nitrogen-containing aromatic groups. Among these, preferable are a compound having a phospholyl group, a sulfoxide group, an amide group (provided that the amide group has no >N—H group and is blocked as >N—Ra wherein Ra is a substituent other than H), an urethane group (provided that the urethane group has no >N—H group and is blocked as >N—Ra wherein Ra is a substituent other than H), an ureido group (provided that the ureido group has no >N—H group and is blocked as >N—Ra wherein Ra is a substituent other than H).

In the invention, a particularly preferable compound which can form a hydrogen bond is a compound represented by the general formula (II) described in Japanese Patent Application No. 2000-358846.

Specific examples of the compound which can form a hydrogen bond used in the invention include compounds described in Japanese Patent Application No. 2000-358846.

Specific examples of the compound which can form a hydrogen bond include compounds described in Japanese Patent Applications Nos. 2000-192191 and 2000-194811.

The compound represented by the general formula (II) described in Japanese Patent Application No. 2000-358846, which is used in the invention, may be incorporated, as a solution, an emulsion, or a solid fine grain dispersion, into the coating solution, whereby the compound can be used in the photosensitive material. The above-mentioned compound in a solution state forms a hydrogen bonding complex with a compound having a phenolic hydroxyl group or an amino group. In a case of a specific combination of the reducing agent with the compound represented by the above-mentioned general formula (II), the complex can be isolated as a crystal. In order to gain stable performance, it is particularly preferable to use the thus-isolated crystal powder as a solid fine grain dispersion. It is also preferable to use a method in which powder of the reducing agent is mixed with powder of the compound represented by the general formula (II) and an appropriate dispersant to form a complex at the time of dispersing the mixture with a sand grinder mill or the like.

The use amount of the compound represented by the general formula (II) is preferably from 1 to 200% by mole of the reducing agent, more preferably from 10 to 150% by mole thereof, and most preferably from 30 to 100% by mole thereof.

A binder of the organic silver salt-containing layer (photosensitive layer) in the invention may be any polymer, and a preferable binder is a binder made of a transparent or semitransparent, colorless, natural or synthetic polymer or copolymer (i.e., resin), or medium which can be made into a film. Examples thereof include gelatins, rubbers, polyvinyl alcohol, hydroxyethylcelluloses, cellulose acetates, cellulose acetate butylates, polyvinyl pyrrolidone, casein, starch, polyacrylates, polymethylmethacrylic acids, polyvinyl chlorides, polymethacrylic acids, styrene-maleic anhydride copolymers, styrene-acrylonitrile copolymers, styrene-butadiene copolymers, polyvinylacetals such as polyvinylformal and polyvinylbutyral, polyesters, polyurethanes, phenoxy resin, polyvinylidene chlorides, polyepoxides, polycarbonates, polyvinyl acetates, polyolefins, cellulose esters, and polyamides. The binder may be formed into a coat from an aqueous or organic solution or from an emulsion.

In the invention, it is preferable that the glass transition temperature of the binder in the organic silver salt-containing layer (photosensitive layer) is from 10 to 80° C. Such a binder may be referred to as a high Tg binder hereinafter. The glass transition temperature is more preferably from 20 to 70° C., and most preferably from 23 to 65° C.

In the present specification, Tg of a polymer is calculated from the following equation:

$$1/Tg=\Sigma(Xi/Tgi)$$

In the polymer, n (i=1 to n) monomer components are copolymerized. Xi represents the weight fraction of the $i^{th}$ monomer ($\Sigma Xi=1$). Tgi represents the glass transition temperature (absolute temperature) of a homopolymer of the $i^{th}$ monomer. The symbol $\Sigma$ is a sum of components of i=1 to n. The value described in "Polymer Handbook ($3^{rd}$ edition)" written by J. Brandrup and E. H. Immergut (Wiley-Interscience, 1989) are adopted as the value (Tgi) of the glass transition temperature of the homopolymer of each of the monomers.

The polymers, each of which will be the binder, may be used alone, or may be, if necessary, used in combination of two or more kinds thereof. A combination of the polymer having a glass transition temperature of 20° C. or more with the polymer having a glass transition temperature below 20° C. maybe used. In the case in which two or more polymers having different Tg's are blended, it is preferable that the weight-average Tg thereof is within the above-mentioned range.

In the invention, the performance thereof is improved in the case in which the coating solution wherein its solvent contains at least 30% by mass of water and the binder thereof is soluble or dispersible in an aqueous solvent (water solvent), particularly the binder thereof is made of a latex of a polymer whose equilibrium moisture content at 25° C. and 60% RH is 2% or less by mass is applied and dried to form the organic silver salt-containing layer (photosensitive layer). The most preferable form is a binder whose ion conductivity is adjusted to 2.5 mS/cm or less. An example of the method of preparing such a binder is a method of synthesizing a polymer and subsequently purifying the polymer by a separation function membrane.

The above-mentioned aqueous solvent in which the polymer is soluble or dispersible is water, or a mixture of water and 70% or less by mass of an organic solvent miscible with water. Examples of the organic solvent miscible with water include alcohols such as methyl alcohol, ethyl alcohol, and propyl alcohol; cellosolves such as methylcellosolve, ethylcellosolve and butylcellosolve; ethyl acetate; and dimethylformamide.

A system in which the polymer is not thermodynamically dissolved but is dispersed is also included in the category of the aqueous solvent.

The "equilibrium moisture content at 25° C. and 60% RH" can be represented as follows: using the weight $W_1$ of a polymer which is in a moisture conditioning equilibrium under an atmosphere of 25° C. and 60% RH and the weight $W_0$ of the polymer which is in an absolutely dry state at 25° C.:

equilibrium moisture content at 25° C. and 60% RH={$(W_1 - W_0)/W_0$}×100 (% by mass About the definition of the water content and the method of measuring it, the following can be referred to: for example, Kobunshi Kogaku Koza 14, Macromolecular Material Testing Methods (edited by the Society of Polymer Science, Japan, and published by Chijin Syokan).

The equilibrium moisture content at 25° C. and 60% RH of the binder polymer in the organic silver salt-containing layer (photosensitive layer) in the invention is preferably 2% or less by mass, more preferably from 0.01 to 1.5% by mass, and most preferably from 0.02 to 1% by mass.

In the invention, the polymer dispersible in the aqueous solvent is particularly preferable. Examples of the dispersion include a latex in which fine particles of a hydrophobic polymer, which is insoluble in water, are dispersed, and a product in which polymer molecules are dispersed in a molecular state or in a micelle state. The two are preferable. The average particle size of the dispersed particles is from about 1 to 50,000 nm, and more preferably from about 5 to 1,000 nm. The particle size distribution of the dispersed particles is not particularly limited, and may be a broad particle size distribution or a mono-dispersive distribution.

Preferable examples of the polymer dispersible in the aqueous solvent include hydrophobic polymers such as acrylic polymers, polyesters, rubbers (for example, SBR resin), polyurethanes, polyvinyl chlorides, polyvinyl acetates, polyvinylidene chlorides, and polyolefins. These polymers may be straight-chain polymers, branched polymers, or crosslinked polymers. These polymers may be homopolymers, each of which is produced by polymerizing one kind of monomer, or as copolymers, each of which is produced by polymerizing two or more kinds of monomers. In the case of the copolymer, the copolymer may be a random copolymer or a block copolymer. The number average molecular weight of these polymers is from 5,000 to 1,000,000, and preferably from 10,000 to 200,000. If the molecular weight is too small, the dynamic strength of the emulsion layer is insufficient. If the molecular weight is too large, the film-forming ability is undesirable.

Preferable specific examples of the polymer latex include the following. The examples are represented by ingredient monomers, and numerical values in parentheses represent percentages by mass (% by mass). Molecular weights in parentheses are number average molecular weights. In the case in which a polyfunctional monomer is used, the concept of any molecular weight cannot be used since the monomer will make a crosslink structure. Therefore, for such a polymer, the word "crosslinking" is used and description on any molecular weight is omitted. Tg means glass transition temperature.

P-1: latex (molecular weight: 37,000) of -MMA(70)-EA(27)-MAA(3),

P-2: latex (molecular weight: 40,000) of -MMA(70)-2EHA(20)-St(5)-AA(5),

P-3: latex (crosslinking) of -St(50)-Bu(47)-MAA(3)-,

P-4: latex (crosslinking) of -St(68)-Bu(29)-AA(3)-,

P-5: latex (crosslinking, Tg: 24° C.) of -St(71)-Bu(26)-AA(3)-,

P-6: latex (crosslinking) of -St(70)-Bu(27)-IA(3)-,

P-7: latex (crosslinking) of -St(75)-Bu(24)-AA(1)-,

P-8: latex (crosslinking) of -St(60)-Bu(35)-DVB(3)-MAA(2)-,

P-9: latex (crosslinking) of -St(70)-Bu(25)-DVB(2)-AA(3)-,

P-10: latex (molecular weight: 80,000) of -VC(50)-MMA(20)-EA(20)-AN(5)-AA(5)-,

P-11: latex (molecular weight: 67,000) of -VDC(85)-MMA(5)-EA(5)-MAA(5)-,

P-12: latex (molecular weight: 12,000) of -Et(90)-MMA(10)-,

P-13: latex (molecular weight: 130,000) of -St(70)-2EHA(27)-AA(3)-,

P-14: latex (molecular weight: 33,000) of -MMA(63)-EA(35)-AA(2)-,

P-15: latex (crosslinking, Tg: 23° C.) of -St(70.5)-Bu(26.5)-AA(3)-, and

P-16: latex (crosslinking, Tg: 20.5° C.) of -St(69.5)-Bu(27.5)-AA(3)-.

The above-mentioned abbreviations represent the following monomers.

MMA: methyl methacrylate, EA: ethyl acrylate, MAA: methacrylic acid, 2EHA: 2-ethylhexyl acrylate, St: styrene, Bu: butadiene, AA: acrylic acid, DVB: divinylbenzene, VC: vinyl chloride, AN: acrylonitrile, VDC: vinylidene chloride, Et: ethylene, and IA: itaconic acid.

The above-mentioned polymer latexes are commercially available. The following Polymer can be used. Examples of the acrylic polymer include Cebian A-4635, 4718 and 4601 (made by Daicel Chemical Industries, Ltd.), and Nipol Lx 811, 814, 821, 820 and 857 (made by Zeon Corporation). Examples of polyesters include FINETEX ES650, 611, 675 and 850 (Dainippon Ink and Chemicals, Incorporated), and WD-size, and WMS (made by Eastman Chemical). Examples of the polyurethanes include HYDRAN AP 10, 20, 30 and 40 (Dainippon Ink and Chemicals, Incorporated). Examples of the rubber include LACSTAR, 7310K, 3307B, 4700H, and 7132C (Dainippon Ink and Chemicals, Incorporated), and Nipol Lx 416, 410, 438C, and 2507 (made by Zeon Corporation). Examples of the polyvinyl chlorides include G351, and G576 (made by Zeon Corporation). Examples of the polyvinylidene chlorides include L502, and L513 (made by Asahi Chemical Industry Co., Ltd.). Examples of the polyolefins include Chemipearl S120 and SA100 (Mitsui Petrochemical Industries, Ltd.).

These polymer latexes may be used alone or may be, if necessary, used in combination of two or more kinds thereof.

A latex of styrene-butadiene copolymer is particularly preferable as the polymer latex used in the invention. The weight ratio of the styrene monomer unit to the butadiene monomer unit in the styrene-butadiene copolymer is preferably from 40/60 to 95/5. The ratio of the styrene monomer unit and the butadiene monomer unit in the copolymer is preferably from 60 to 99% by mass. A preferable molecular weight thereof is the same as described above.

Preferable examples of the latex of the styrene-butadiene copolymer used in the invention include the above-mentioned P-3 to P-8, P-14 and P-15, and LACSTAR-3307B, 7132C, and Nipol Lx 416, which are commercially available.

If necessary, the organic silver salt-containing layer (photosensitive layer) of the heat-developable photosensitive material of the invention can contain a hydrophilic polymer such as gelatin, polyvinyl alcohol, methylcellulose, hydroxypropylcellulose, or carboxymethylcellulose. The adding amount of the hydrophilic polymer is preferably 30% by mass or less, and more preferably 20% by mass or less of all of the binders in the organic silver salt-containing layer (photosensitive layer).

The organic silver salt-containing layer (photosensitive layer) in the invention is preferably formed using the polymer latex. About the amount of the binder in the organic silver salt-containing layer (photosensitive layer), the weight ratio of all the binders to the organic silver salt is preferably from 1/10 to 10/1, and more preferably from 1/5 to 4/1.

This organic silver salt-containing layer (photosensitive layer) is usually a photosensitive layer (emulsion layer)

containing a photosensitive silver halide, which is a photosensitive silver salt. In this case, the weight ratio of all the binders to the photosensitive silver halide is preferably from 400 to 5, more preferably from 200 to 10.

The amount of all the binders in the image forming layer in the invention is preferably from 0.2 to 30 g/m$^2$, and more preferably from 1 to 15 g/m$^2$. The image forming layer in the invention may contain a crosslinking agent, a surfactant for improving coating properties.

In the invention, the solvent of the coating solution for the organic silver salt-containing layer of the photosensitive material is preferably an aqueous solvent containing 30% by mass or more of water. (For simplicity, the word "solvent" means a combination of the solvent with a dispersion medium.) Examples of a component other than water include all water-miscible organic solvents such as methyl alcohol, ethyl alcohol, isopropyl alcohol, methylcellosolve, ethylcellosolve, dimethylformamide, and ethyl acetate. The water content in the solvent of the coating solution is preferably 50% by mass or more, and more preferably 70% by mass or more. Preferable examples of the composition of the solvent include water, water/methyl alcohol=90/10, water/methyl alcohol=70/30, water/methyl alcohol/dimethylformamide=80/15/5, water/methyl alcohol/ethylcellosolve=85/10/5, and water/methyl alcohol/isopropyl alcohol=85/10/5 (the numbers being percentages by mass).

Examples of an anti-fogging agent, a stabilizer, a stabilizer precursor which can be used in the invention include compounds described in JP-A No.10-62899 (paragraph 0070), EP No. 0,803,764A1 (page 20, line 57 to page 21, line 7), JP-A Nos. 9-281637 and 9-329864. The anti-fogging agent preferably used in the invention is an organic halide. Examples thereof include halides disclosed in JP-A No. 11-65021 (paragraphs 0111 to 0112). Particularly preferable are organic halide compounds represented by the formula (P) in Japanese Patent Application No. 11-87297, organic polyhalide compounds represented by the general formula (II) in JP-A No. 10-339934, and organic polyhalide compounds described in Japanese Patent Application No. 11-205330. In addition, preferable examples of the organic polyhalide compound which is used in the invention are compounds represented by the general formula (III) described in Japanese Patent Application No. 2000-358846. Specific examples of the compound are described in the specification of this patent application.

In the invention, the compound represented by the general formula (III) described in Japanese Patent Application No. 2000-358846 is used preferably in an amount within the range of $10^{-4}$ to 1 mole, more preferably in an amount within the range of $10^{-3}$ to 0.8 mole, and most preferably in an amount within the range of $5\times10^{-3}$ to 0.5 mole per mole of the non-photosensitive organic silver salt in the image forming layer.

Examples of the method of incorporating the anti-fogging agent into the photosensitive material include the same method as that for incorporating the reducing agent therein. It is preferable that the organic polyhalide compound is also added in the form of a solid fine grain dispersion.

Other examples of the anti-fogging agent include mercury (II) salts described in JP-A No. 11-65021 (paragraph 0113), benzoic acid,s in the same publication (paragraph 0114) salicylic acid derivatives in JP-A No. 2000-206642, formalin scavenger compounds represented by the formula (S) in the JP-A No. 2000-221634, triazine compounds in JP-A No. 11-352624 (claim 9), compounds represented by the general formula (III) in JP-A No. 6-11791, and 4-hydroxy-6-methyl-1, 3, 3a, 7-tetrazaindene.

The heat-developable photosensitive material of the invention may contain an azolium salt in order to prevent fogging. Examples of the azolium salt include compounds represented by the general formula (XI) described in JP-A No. 59-193447, compounds described in JP-B No. 55-12581, and compounds represented by the general formula (II) described in JP-A No. 60-153039. The azolium salt may be added to any portion of the photosensitive material. The azolium salt is preferably added to any layer which is on the photosensitive layer side, and is more preferably added to the organic silver salt-containing layer (photosensitive layer). The addition of the azolium slat may be performed in any step in the preparation of the coating solution. In the case in which the salt is added to the organic silver salt-containing layer, the addition may be performed in any step from the time of preparing the organic silver salt to the time of preparing the coating solution, and is preferably performed after the preparation of the organic silver salt and immediately before the coating with the coating solution. The addition of the azolium salt may be performed in any form, for example, in the form of powder, solution or fine grain dispersion. The azolium salt may be added in the form of a solution wherein the salt is mixed with other additive such as a sensitizing dye, a reducing agent, or a color tone adjusting agent. In the invention, the adding amount of the azolium salt may be arbitrary. The amount is preferably from $1\times10^{-6}$ to 2 moles, and more preferably from $1\times10^{-3}$ to 0.5 mole per mole of silver.

In order to restrain or accelerate the development to control the development, improve spectrally-sensitizing efficiency, or improve the storability before and after the development, a mercapto compound, a disulfide compound, and/or a thione compound may be incorporated into the photosensitive material. These compounds are disclosed in JP-A Nos. 10-62899 (paragraphs 0067 to 0069), and 10-186572 (compounds represented by the general formula (I), and specific examples in paragraphs 0033 to 0052), EP No. 0,803,764A1 (page 20, lines 36 to 56), Japanese Patent Application No. 11-273670, and the like. Among these compounds, mercapto-substituted heteroaromatic compounds are preferable.

A color adjusting agent is preferably added to the heat-developable photosensitive material of the invention. The color adjusting agent is described in JP-A No. 10-62899 (paragraphs 0054 to 0055). EP No. 0,803,764A1 (page 21 lines 23 to 48), JP-A No. 2000-356317, and Japanese Patent Application No. 2000-187298. Particularly preferable are the following: phthalazinones (phthalazinone, phthalazinone derivatives or metal salts thereof, for example, 4-(1-naphthyl)phthalazinone); 6-chlorophthalazinone, 5,7-dimethoxyphthalazinone, and 2,3-dihydro-1,4-phthalazinedione); combinations of phthalazinones with phthalic acids(for example, phthalic acid, 4-methylphthalic acid, 4-nitrophthalic acid, diammonium phthalate, sodium phthalate, potassium phthalate, and tetrachlorophthalic anhidride); phthalazines (phthalazine, phthalazine derivatives, or metal salts thereof, for example, 4-(1-naphthyl)phthalazine, 6-isopropylphthalazine, 6-t-butylphthalazine, 6-chlorophthalazine, 5,7-dimethoxyphthalazine, and 2,3-dihydrophthalazine); combinations of phthalazines with phthalic acids. Combinations of phthalazines with phthalic acids are more preferable.

A plasticizer and a lubricant which can be used in the photosensitive layer of the invention are described in, for example, JP-A No. 11-65021 (paragraph 0117). A superhighly contrasting agent for forming a superhighly contrasty image, a method of adding the same, and an amount thereof are described in, for example, JP-A Nos. 11-65021 (paragraph 0118) and 11-223898 (paragraphs 0136 to 0193), Japanese Patent Application No. 11-87297 (compounds represented by the formulae (H), (1) to (3), (A) and (B)), Japanese Patent Application No. 11-91652 (compounds represented by the general formulae (III) to (V)) (specific examples of the compounds: compounds 21 to 24), and a superhighly contrasting accelerator is described in, for example, JP-A Nos. 11-65021 (paragraph 0102) and 11-223898 (paragraphs 0194 to 0195).

In order to use formic acid, or a formic salt as a strong fogging material, it is preferable that the heat-developable photosensitive material contains, on a side having the image forming layer that contains a photosensitive silver halide, the acid or the salt in an amount of 5 mmole or less, and particularly 1 mmole or less per mole of silver.

In the case in which the super-high contrasting agent is used in the heat-developable photosensitive material of the invention, it is preferable to use an acid obtained by hydration of diphosphorous pentoxide, or a salt thereof with the super-high contrasting agent. Examples of the acid obtained by hydration of diphosphorous pentoxide, or the salt thereof include metaphosphoric acid (salts thereof), pyrophosphoric acid (salts thereof), orthophosphoric acid (salts thereof), triphosphoric acid (salts thereof), tetraphosphoric acid (salts thereof), and hexametaphosphoric acid (salts thereof). Preferable examples thereof are orthophosphoric acid (salts thereof) and hexametaphosphoric acid (salts thereof). Specific examples thereof include sodium orthophosphate, sodium dihydrogen phosphate, sodium hexametaphosphate, and ammonium hexametaphosphate.

The use amount (coating amount per $m^2$ of the photosensitive material) of the acid obtained by hydration of diphosphorous pentoxide, or the salt thereof may vary in accordance with desired performances such as sensitivity and fog prevention, and is preferably from 0.1 to 500 $mg/m^2$, and more preferably from 0.5 to 100 $mg/m^2$.

Layer Structure

In order to prevent adhesion of the image forming layer to any material, the heat-developable photosensitive material of the invention may comprise a surface protective layer. The surface protective layer may be made of a monolayer or a multilayer. The surface protective layer is described in, for example, JP-A No. 11-65021 (paragraphs 0119 to 0120), and Japanese Patent Application No. 2000-171936.

A binder of the surface protective layer in the invention is preferably gelatin, or polyvinyl alcohol (PVA), or a combination of gelatin with PVA. Examples of the gelatin include inert gelatin (for example, Nitta Gelatin 750), and phthalated gelatin (for example, Nitta Gelatin 801). Examples of PVA are described in JP-A No. 2000-171936 (paragraphs 0009 to 0020), and preferable examples thereof include PVA-105, which is a completely saponificated product, PVA-205 and PVA-335, which are partially saponificated products, and MP-203, which is modified PVA, which are names of products made by Kurary Co., Ltd. The coating amount (per $m^2$ of the substrate) of polyvinyl alcohol in the protecting layer or in each of the protecting layers is preferably from 0.3 to 4.0 $g/m^2$, and more preferably from 0.3 to 2.0 $g/m^2$.

In the case in which the heat-developable photosensitive material of the invention is used for printing wherein a change in dimension comes into question, it is preferable to use a polymer latex in the surface protective layer or a back layer. Such a polymer latex is described in "Synthetic Resin Emulsion (edited by Taira Okudaira and Hiroshi Inagaki, and published by Kobunsi Kanko-kai (1978))", "Application of Synthetic latex (edited by Takaaki Sugimura, Yasuo Kataoka, Soichi Suzuki, and Keizi Kasahara, and published by Kobunshi Kanko-kai (1993)", and "Chemistry on Synthetic Latex (written by Soichi Muroi, and published by Kobunshi Kanko-kai (1970))", and the like. Specific examples thereof include a copolymer latex of methyl methacrylate (33.5% by mass)/ethyl acrylate (50% by mass)/methacrylic acid (16.5% by mass), a copolymer latex of methyl methacrylate (47.5% by mass)/butadiene(47.5% by mass)/itaconic acid (5% by mass), a copolymer latex of ethyl acrylate/methacrylic acid, a copolymer latex of methyl methacrylate (58.9% by mass)/2-ethylhexyl acrylate (25.4% by mass)/styrene (8.6% by mass)/2-hydroxyethyl methacrylate (5.1% by mass)/acrylic acid (2.0% by mass), and a copolymer latex of methyl acrylate (64.0% by mass)/styrene (9.0% by mass)/butyl acrylate (20.0% by mass)/2-hydroxyethyl methacrylate (5.0% by mass)/acrylic acid (2.0% by mass). For the binder for the surface protective layer, the following techniques may be used: a combination of polymer latexes described in Japanese Patent Application No. 11-6872, a technique described in Japanese Patent Application No. 11-143058 (paragraphs 0021 to 0025) a technique described in Japanese Patent Application No. 11-6872 (paragraphs 0027 to 0028), or a technique described in Japanese Patent Application No. 10-199626 (paragraphs 0023 to 0041). The ratio of the polymer latex in the surface protective layer is preferably from 10 to 90%, and more preferably from 20 to 80% by mass of all the binders.

The coating amount (per $m^2$ of the substrate) of all the binders (containing the water-soluble polymer and the latex polymer) in the surface protective layer or in each of the surface protective layers is preferably from 0.3 to 5.0 $g/m^2$, and more preferably from 0.3 to 2.0 $g/m^2$.

The preparation temperature of the image forming layer coating solution in the invention is preferably from 30 to 65° C., more preferably from 35 to less than 60° C. and most preferably from 35 to 55° C. It is preferable that the temperature of the image forming layer coating solution immediately after the addition of the polymer latex is kept at 30 to 65° C.

The image forming layer in the invention is made of one or more layers on the substrate. In the case in which the image forming layer is made of a single layer, the layer is composed of an organic silver salt, a photosensitive silver halide, a reducing agent and a binder. If necessary, the layer contains desired additional materials such as a color adjusting agent, a coating auxiliary agent and other auxiliary agent. In the case in which the image forming layer is made of two or more layers, it is necessary that the first image forming layer, which is usually adjacent to the substrate, contains an organic silver salt and a photosensitive silver halide. The second image forming layer or both of the first and second layers must contain the other components. In the structure of the multicolor heat-developable photosensitive photographic material, the above-mentioned combination of these layers may be used for each of the colors. All the components may be contained in a single layer as described in U.S. Pat. No. 4,708,928. In the case of a multicolor, photosensitive, heat-developable photographic material containing a plurality of dyes, respective emulsion layers thereof are generally distinguished from each other by using a functional or non-functional barrier layer between the respective photosensitive layers, as described in U.S. Pat. No. 4,460,681.

In order to improve the color tone, prevent the generation of interference fringes at the time of laser exposure, and prevent irradiation, various dyes or pigments (For example, C. I. Pigment Blue 60, C.I. Pigment Blue 64, and C. I. Pigment Blue 15:6) may be used in the photosensitive layer. These are described in WO 98/36322, JP-A Nos. 10-268465, 11-338098, and the like.

In the heat-developable photosensitive material of the invention, an antihalation layer may be formed at the side farther, with respect to the photosensitive layer, from a light source.

A heat-developable photosensitive material in general has not only a photosensitive layer but also a non-photosensitive layer. The non-photosensitive layer can be classified into the following from the viewpoint of the arrangement thereof: (1) a protective layer formed on/over the surface (farther from the substrate) of the photosensitive layer, (2) an intermediate layer between the photosensitive layers, or between the photosensitive layer and the protective layer, (3) an undercoat layer formed between the photosensitive layer and the substrate, and (4) a back layer provided on the surface of the substrate which is opposite to the surface having disposed thereon a photosensitive layer. A filter layer is provided as the layer (1) or layer (2) in the photosensitive material, and the antihalation layer is provided as the layer (3) or (4) in the photosensitive material.

The antihalation layer is described in JP-A Nos. 11-65021 (paragraphs 0123 to 124), 11-223898, 9-230531, 10-36695, 10-104779, 11-231457, 11-352625, 11-352626, and the like.

The antihalation layer contains an antihalation dye having an absorption wavelength within the range of wavelengths for exposure. In the case in which the exposure wavelengths are within the range of infrared rays, an infrared ray absorbent can be used as the antihalation dye. In this case, a dye having no absorption wavelength within the range of visible rays is preferable.

In the case in which the dye having an absorption wavelength within the range of visible rays is used to prevent halation, it is preferable that the color of the dye does not substantially remain after an image is formed. It is preferable to use means for erasing the color by heat based on heat development. It is particularly preferable to add a heat color-erasing dye and a base precursor to the non-photosensitive layer which is to function as the antihalation layer. These techniques are described in JP-A No. 11-231457 and the like.

The adding amount of the color-erasing dye is decided in accordance with the use of the dye. In general, the dye is used such that the optical density (absorbance), which is measured with a target wavelength, is more than 0.1. The optical density is preferably from 0.2 to 2. The use amount of the dye for obtaining such an optical density is generally from about 0.001 to 1 g/m$^2$.

When the color of the dye is erased in such a manner, the optical density after heat development can be lowered to 0.1 or less. Two or more kinds of the color-erasing dyes may be used together in a heat-erasable photosensitive material or the heat-developable photosensitive material. Similarly, two or more kinds of the base precursors may be used together.

In the heat-erasion using the color-erasing dye and the base precursor in this way, the precursor being a basic precursor as described in JP-A No. 11-352626, it is preferable from the viewpoint of heat-erasability and the like to use a material for causing the melting point to be lowered by 3° C. (degree) or more (for example, diphenylsulfone, or 4-chlorophenyl(phenyl)sulfone) at the same time.

In order to improve silver color tone, and performance against a change of images with time, a colorant having a maximum absorption wavelength of 300 to 450 nm can be added to the photosensitive material of the invention. Such a colorant is described in JP-A Nos. 62-210458, 63-104046, 63-103235, 63-208846, 63-306436, 63-314535 and 01-61745, Japanese Patent Application No. 11-276751, and the like.

Such a colorant is added generally in an amount of 0.1 to 1 g/m$^2$. The layer to which the colorant is added is preferably the back layer formed on the surface of the sbstrate which is opposite to the surface having disposed thereon the photosensitive layer.

The heat-developable photosensitive material of the invention is preferably the so-called one-side photosensitive material, which has at least one silver halide emulsion on one side of the substrate and has a back layer on the opposite side of the substrate.

In order to improve the conveyance property of the photosensitive material of the invention, it is preferable to add a matting agent thereto. The matting agent is described in, for example, JP-A No. 11-65021 (paragraphs 0126 to 0127). The coating amount of the matting agent is preferably from 1 to 400 mg, and more preferably from 5 to 300 mg per m$^2$ of the photosensitive material.

The mat degree of the emulsion surface is not limited if no stardust defect is generated. The Beck smoothness thereof is preferably from 30 to 2,000 seconds, and more preferably from 40 to 1,500 seconds. The Beck smoothness can easily be measured according to "Smoothness Testing Method of Paper and Paperboard Using Beck Tester" in JIS (Japanese Industrial Standard) P 8119, and TAPPI Standard Method T479.

About the mat degree of the back layer in the invention, the Beck smoothness thereof is preferably from 10 to 1200 seconds, more preferably from 20 to 800 seconds, and most preferably from 40 to 500 seconds.

In the invention, it is preferable that the matting agent is contained in the outermost layer of the photosensitive material, a layer functioning as the outermost layer, or a layer near the outer surface, and it is preferable that the matting agent is contained in a layer acting as the protective layer.

The back layer which can be used in the invention is described in JP-A No. 11-65021 (paragraphs 0128 to 0130).

In the heat-developable photosensitive material of the invention, the film face pH thereof before heat development is preferably 7.0 or less, and more preferably 6.6 or less. The lower limit thereof is not particularly limited, but is about 3. The most preferable range of the pH is within the range of 4 to 6.2. In order to reduce the film face pH, it is preferable to use an organic acid such as a phthalic acid derivative, a nonvolatile acid such as sulfuric acid, or a volatile base such as ammonia. Ammonia is particularly preferable in order to attain a low film face pH since it volatilizes easily and it can be removed in the step of coating or before heat development.

It is also preferable to use a nonvolatile base such as sodium hydroxide, potassium hydroxide or lithium hydroxide together with ammonia. A method of measuring the film face pH is described in paragraph 0123 of Japanese Patent Application No. 11-87297.

A film hardener may be used in the respective layers, for example, in the photosensitive layer, the protecting layer and/or the back layer. Examples of the film hardener are described on pages 77 to 87 of "THE THEORY OF THE PHOTOGRAPHIC PROCESS FOURTH EDITION" written by T. H. James (published in 1977 by Macmillan Publishing Co., Inc.). For example, the following are preferably used: chrome alum, a sodium salt of 2,4-dichloro-6-hydroxy-s-triazine, N,N-ethylenebis(vinylsulfoneacetamide), N,N-propylenebis(vinylsulfoneacetamide), polyvalent metal ions described on page 78 of the same document, polyisocyanates described in U.S. Pat. No. 4,281,060, JP-A No. 6-208193, epoxy compounds described in U.S. Pat. No. 4,791,0420, vinylsulfone compounds described in JP-A No. 62-89048 and the like.

The film hardener is added in the form of a solution thereof, and the timing of adding this solution to the protective layer coating solution is from 180 minutes before coating thereof to a time immediately before the coating, preferably from 60 minutes before the coating to 10 seconds before the coating. The method of mixing the film hardener solution with the coating solution, and conditions for the mixing are not particularly limited if the effect of the invention is sufficiently produced. Specific examples of the mixing method include a method of mixing them in a tank wherein an average residence time, which is calculated from an addition flow rate and an amount of a solution sent to a coater, is set to a desired time, and a method using a static mixer, described in Chapter 8 of "Liquid Mixing Technique" (published by Nikkan Kogyo Shimbun, Ltd. in 1989) written by N. Harnby, M. F. Edwards and A. W. Nienow, and translated by Koji Takahashi.

The surfactant which can be used in the invention is described in paragraph 0132 in JP-A No. 11-65021; the solvent, in paragraph 0133 in the same publication; the substrate, in paragraph 0134 in the same publication; the antistatic layer or a conductive layer, in paragraph 0135 in the same publication; the method of obtaining color images, in paragraph 0136 of the same publication; and the lubricant, in paragraphs 0061 to 0064 in JP-A No. 11-84573 and in paragraphs 0049 to 0062 in Japanese Patent Application No. 11-106881.

Substrate

As the substrate which is used in the invention, there is preferably used a transparent substrate, such as a polyester substrate, subjected to heat treatment within the temperature range of 130 to 185° C. to relieve inner strain remaining in the film at the time of biaxial orientation and remove thermal contraction strain generated in heat development, particularly a polyethylene terephthalate substrate. In the case of a heat-developable photosensitive material for medicine, the transparent substrate may be colored with a blue dye (for example, dye-1 described in Examples in JP-A No. 8-240877), or may not be colored. The following techniques are preferably applied to the substrate: undercoating techniques of water-soluble polyester in JP-A No. 11-84574, styrene-butadiene copolymer in JP-A No. 10-186565, and vinylidene chloride copolymers in JP-A No. 2000-39684 and paragraphs 0063 to 0080 of Japanese Patent Application No. 11-106881. For the antistatic layer or the undercoat layer, the following techniques can be used: JP-A Nos. 56-143430, 56-143431, 58-62646, 56-120519 and 11-84573 (paragraphs 0040 to 0051), U.S. Pat. No. 5,575,957, and JP-A No. 11-223898 (paragraphs 0078 to 0084).

The heat-developable photosensitive material is preferably of a mono-sheet type (i.e., of a type making it possible to form images on the heat-developable photosensitive material without using any other sheet, such as an image receiving material).

The heat-developable photosensitive material may contain an antioxidant, a stabilizer, a plasticizer, an ultraviolet absorbent, or a coating auxiliary. Various additives are added to either of the photosensitive layer and the non-photosensitive layer. About these additives, WO 98/36322, EP No. 803,764A1, JP-A Nos. 10-186567, 10-18568, and the like can be referred to.

Production of the Heat-developable Photosensitive Material

In the heat-developable photosensitive material of the invention, its photosensitive layer is formed by applying and drying a coating solution for the photosensitive layer containing silver behenate.

The heat-developable photosensitive material of the invention may be produced in any manner. Specifically, there are used various coating operations such as extrusion coating, slide coating, curtain coating, dip coating, knife coating, flow coating, or extrusion coating using a hopper of a type described in U.S. Pat. No. 2,681,294. There is preferably used extrusion coating described on pages 399 to 536 of "LIQUID FILM COATING" written by Stephen F. Kistler, and Petert M. Schweizer (published in 1997 by CHAPMAN & HALL Co.), or slide coating. Particularly preferable is slide coating.

An example of a slide coater used in slide coating is described in FIG. 11*b*. 1 on page 427 of the same document. If desired, two or more layers can be applied at the same time by a method described in each of the same document (pages 399 to 536), U.S. Pat. No. 2,761,791, and U.K. Patent No. 837,095.

The organic silver salt-containing coating solution (coating solution for a photosensitive layer) in the invention is preferably the so-called thixotropic fluid. About this technique, JP-A No. 11-52509 can be referred to. About the organic silver salt-containing coating solution of the invention, the viscosity thereof at a shear speed of 0.1 $S^{-1}$ is from 400 to 100,000 mPa.s, and more preferably from 500 to 20,000 m.Pas. The viscosity at a shear speed of 1000 $S^{-1}$ is preferably from 1 to 200 mPa.s, and more preferably from 5 to 80 mPa.s.

Other examples of the technique which can be used for the heat-developable photosensitive material of the invention are described in EP Nos.803,764A1, and 883,022A1, WO 98/36322, JP-A Nos. 56-62648, 58-62644, 9-43766, 9-281637, 9-297367, 9-304869, 9-311405, 9-329865, 10-10669, 10-62899, 10-69023, 10-186568, 10-90823, 10-171063, 10-186565, 10-186567, 10-186569 to 10-186572, 10-197974, 10-197982, 10-197983, 10-197985 to 10-197987, 10-207001, 10-207004, 10-221807, 10-282601, 10-288823, 10-288824, 10-307365, 10-312038, 10-339934, 11-7100, 11-15105, 11-24200, 11-24201, 11-30832, 11-84574, 11-65021, 11-109547, 11-125880, 11-129629, 11-133536 to 11-133539, 11-133542, 11-133543, 11-223898, 11-352627, 11-305377, 11-305378, 11-305384, 11-305380, 11-316435, 11-327076, 11-338096, 11-338098, 11-338099 and 11-343420, and Japanese Patent Application Nos. 2000-187298, 2000-10229, 2000-47345, 2000-206642, 2000-98530, 2000-98531, 2000-112059, 2000-112060, 2000-112104, 2000-112064, and 2000-171936.

<Exposure and Heat Development>

The heat-developable photosensitive material of the invention may be developed by any method. Usually, the heat-developable photosensitive material which has been imagewise exposed to light is heated to be developed. Development temperature is preferably from 80 to 250° C., and more preferably from 100 to 140° C. Development time is preferably from 1 to 60 seconds, more preferably from 5 to 30 seconds, and most preferably from 10 to 20 seconds.

The manner of the heat development is preferably a plate heater manner. A preferable example of the heat development according to the plate heater manner is described in JP-A No. 11-133572. A heat development device used in this manner is a heat development device capable of obtaining a visible image by bringing a heat-developable photosensitive material on which a latent image is formed into contact with a heating means in a heat-developing section, wherein the heating means comprises a plate heater, plural pressing rolls are arranged oppositely along one face of the plate heater, and the heat-developable photosensitive material is caused to pass between the pressing rolls and the plate heater to carry out heat development. It is preferable to separate the plate heater into 2 to 6 units and further lower the temperature of the tip portion thereof by about 1 to 10° C. Such a manner is also described in JP-A No. 54-30032. Water content and organic solvents contained in the heat-developable photosensitive material can be removed outside the system. It is also possible to suppress a change in the shape of the substrate of the heat-developable photosensitive material, the change being based on drastic heating of the photosensitive material.

The heat-developable photosensitive material of the invention may be exposed to light by any method. An exposure source for the exposure is preferably a laser. Preferable examples of the laser in the invention include a gas laser ($Ar^+$, or He—Ne), a YAG laser, a dye laser, and a semiconductor laser. Moreover, a semiconductor laser and a second harmonic generating element can also be used. Preferable is a gas or semiconductor laser for emitting rays from red rays to infrared rays.

Examples of a laser imager for medicine having an exposure section and a heat development section include Fuji Medical Dry laser Imager FM-DP L. The FM-DP L is described on pages 39 to 55 in Fuji Medical Review No. 8. Of course, the technique therein can be used as a laser imager for the heat-developable photosensitive material of the invention. The heat-developable photosensitive material of the invention can be used as a heat-developable photosensitive material for a laser imager in an "AD network", which has been suggested as a network adapted to the DICOM Standard by Fuji medical System.

The heat-developable photosensitive material of the invention can make black and white images due to silver images, and is preferably used as a heat-developable photosensitive materials for medical diagnosis, industrial photography, printing, or COM.

EXAMPLES

Hereinafter, the present invention will be described in detail by way of examples, but the invention is not limited to these examples.

[Production of a PET Substrate]

Terephthalic acid and ethylene glycol were used to yield PET having an intrinsic viscosity IV (measured at 25° C. in phenol and tetrachloroethane (mass ratio=6/4)) of 0.66 by a conventional method. This was made into a pellet form, and then the pellet was dried at 130° C. for 4 hours and melted at 300° C. Thereafter, the melted PET was extruded from a T-shaped die and cooled rapidly. In this way, a film which has not yet been oriented was produced in such a manner that the film thickness thereof after heat fixation was 175 μm.

Rolls having different peripheral speeds were used to orient this film 3.3 times lengthwise, and a tenter was used to orient the film 4.5 times sideways. The temperatures at these times were 110° C. and 130° C., respectively. Thereafter, the film was subjected to heat fixation at 240° C. for 20 seconds, and then relieved by 4% sideways at the same temperature. Thereafter, a chuck unit of the tenter was slit and subsequently both ends thereof were subjected to knurl working. The film was wound at4 kg/cm$^2$, and made into the form of a roll having a thickness of 175 μm.

[Surface Corona Treatment]

A solid state corona treatment machine model 6KVA, made by Pillar Co. was used to treat both faces of the substrate at room temperature and a speed of 20 m/minute. It was found out from read current and voltage values that the substrate was treated at 0.375 kV 'A' minutes/m$^2$. At this time, the frequency for the treatment was 9.6 kHz, and the gap clearance between the electrode and the dielectric roll was 1.6 mm.

[Production of an Undercoated Substrate]

(1) Production of a coating solution for an undercoat layer

| | |
|---|---|
| (30 mass % solution) | 234 g |
| polyethylene glycol monononyl phenyl ether (10 mass % solution) (average ethylene oxide number = 8.5) | 21.5 g |
| MP-1000 (polymer fine grains, average grain size: 0.4 μm) made by Soken Chemical & Engineering Co., Ltd. | 0.91 g |
| distilled water | 744 ml |

Formulation (2) (for a first layer on the side of the back face)

| | |
|---|---|
| styrene-butadiene copolymer latex (solid content: 40 mass %, styrene/butadiene (weight ratio) = 68/32) | 158 g |
| sodium salt of 2,4-dichloro-6-hydroxy-S-triazine (8 mass % aqueous solution) | 20 g |
| sodium laurylbenzenesulfonate (1 mass % aqueous solution) | 10 ml |
| distilled water | 854 ml |

(Formulation (3) (for a second layer on the side of the back face)

| | |
|---|---|
| $SnO_2$/SbO (mass ratio: 9/1, average grain size: 0.038 μm, 17 mass % dispersion) | 84 g |
| gelatin (10 mass % aqueous solution) | 89.2 g |
| Metorose TC-5 (2 mass % aqueous solution) made by Shin-Etsu Chemical Co., Ltd) | 8.6 g |
| MP-1000 made by Soken Chemical Kabushiki Kaisha | 0.01 g |
| sodium dodecylbenzenesulfonate (1 mass % aqueous solution) | 10 ml |
| NaOH (1 mass %) | 6 ml |
| Proxel (made by ICI) | 1 ml |
| distilled water | 805 ml |

[Preparation of an Undercoated Substrate]

While the biaxially-oriented polyethylene terephthalate substrate wound into the form of a roll having a thickness of 175 μm was conveyed, both the faces thereof were subjected to the same corona discharge treatment as described above. Thereafter, the one face (photosensitive layer face) was coated with the formulation (1) of the undercoat layer coating solution with a wire bar in such a manner that the wet coating amount thereof was 6.6 ml/m$^2$ (for the one face), and the applied layer was dried at 180° C. for 5 minutes. Next, the-back face was coated with the formulation (2) of the undercoat layer coating solution with a wire bar in such a manner that the wet coating amount thereof was 5.7 ml/m$^2$, and the applied layer was dried at 180° C. for 5 minutes. Furthermore, the back face was coated with the formulation (3) of the undercoat layer coating solution by means of a wire bar in such a manner that the wet coating amount thereof was 7.7 ml/m$^2$, and the applied layer was dried at 180° C. for 6 minutes, so as to produce an undercoated substrate A. Thereafter, the undercoated substrate A was wound at 4 kg/cm$^2$ to be made into a roll form.

An undercoated substrate B was produced in the same manner as in the production of the undercoated substrate A except that "MIOSA MT (hardness: 30°, adhesive force: 35hPa)" made by Miyagawa Roll Kabushiki Kaisha, as an adhesive roll, was brought into contact with both the faces of the undercoated substrate before the undercoat layer coating solution formulation (1) is applied, which is referred to as "before the coating" hereinafter, and both the faces of the substrate immediately before the undercoated substrate was wound, which is referred to as "before the winding" hereinafter. Conditions for using the adhesive roll were as follows. The conveyance speed (line speed) of the substrate and the undercoated substrate before the coating and that before the winding were set to 60 m/min. The contact angle between the adhesive roll and the substrate or the undercoated substrate before the coating was set to 30°, and that before the winding was set to 60°. The tension of the substrate or the undercoated substrate before the coating was set to 80 kgf/width, and that before the winding was also set to 80 kgf/width. Environment for using the adhesive roll was as follows. Temperature, humidity and cleanliness class before the coating were set to 20° C., 60%, and M2.5 to M2.6 (10 to 20/CFM), respectively. Temperature, humidity and cleanliness class before the winding were set to 50° C., 40%, M3.8 to M3.9 (300 to 400/CFM), respectively. Electricity-removing treatment was conducted immediately after the adhesive roll was brought into contact.

Furthermore, undercoated substrates C to E were produced in the same manner as in the production of the undercoated substrate B except that the adhesive roll was changed into kinds shown in Table 1. The hardness and the adhesive force of the used adhesive rolls are shown in Table 1.

[Preparation of a Back Face Coating Solution]

(Preparation of a Solid Fine Grain Aqueous Dispersion (a) of a Base Precursor)

64 g of a base precursor compound 11, 28 g of diphenylsulfone, and 10 g of a surfactant Demol N made by Kao Corporation were mixed with 220 ml of distilled water. The mixed solution was subjected to bead-dispersion using a sand mill (1/4 Gallon sand grinder mill, made by I.mecs) to yield a solid fine grain aqueous dispersion (a) of the base precursor compound having an average grain size of 0.2 $\mu$m.

(Preparation of a Dye Solid Fine Grain Aqueous Dispersion)

9.6 g of a cyanine dye compound 13, and 5.8 g of sodium p-dodecylbenzenesulfonate were mixed with 305 ml of distilled water. The mixed solution was subjected to bead-dispersion using a sand mill (¼ Gallon sand grinder mill, made by I.mecs) to yield a dye solid fine grain aqueous dispersion having an average grain size of 0.2 $\mu$m.

(Preparation of an Antihalation Layer Coating Solution)

The following were mixed: 17 g of gelatin, 9.6 g of polyacrylamide, 70 g of the solid fine grain aqueous dispersion (a) of the base precursor, 56 g of the dye solid fine grain aqueous dispersion, 1.5 g of mono-dispersive fine grains of polymethyl methacrylate (average grain size: 8 $\mu$m, grain size standard deviation: 0.4), 0.03 g of benzoisothiazolinone, 2.2 g of sodium polyethylenesulfonate, 0.2 g of a blue dye compound 14, 3.9 g of a yellow dye compound 15, and 844 ml of water. In this way, an antihalation layer coating solution was prepared.

(Preparation of a Back Face Protective Layer Coating Solution)

The temperature of a container was kept at 40° C., and the following were mixed: 50 g of gelatin, 0.2 g of sodium polystyrenesulfonate, 2.4 g of N,N-ethylenebis (vinylsulfoneacetamide), 1 g of sodium t-octylphenoxyethoxyethanesulfonate, 30 mg of benzoisothiazolinone, 37 mg of a fluorine-containing surfactant (F-1: a potassium salt of N-perfluorooctylsulfonyl-N-propylalanine), 0.15 g of a fluorine-containing surfactant (F-2: polyethylene glycol mono(N-perfluorooctylsulfonyl-N-propyl-2-aminoethyl)ether [ethylene oxide average polymerization degree:15], 64 mg of a fluorine-containing surfactant (F-3), 32 mg of a fluorine-containing surfactant (F-4), 8.8 g of acrylic acid/ethyl acrylate copolymer (copolymerization weight ratio: 5/95), 0.6 g of an aerosol OT (made by American Sianamide Co.), 1.8 g (as a fluid paraffin) of a fluid paraffin emulsion, and 950 ml of water. In this way, a back face protective layer coating solution was prepared.

<<Preparation of a Silver Halide Emulsion-1>>

3.1 ml of 1 mass % potassium bromide solution, 3.5 ml of 0.5 mol/L sulfuric acid, and 31.7 g of phthalated gelatin was added to 1421 ml of distilled water. While this solution was stirred in a reaction vessel made of stainless steel, the temperature of the solution was kept at 30° C. Thereto were added all of solution A, in which distilled water had been added to 22.22 g of silver nitrate so as to increase the volume to 95.4 ml and a solution B, in which distilled water had been added to 15.3 g of potassium bromide and 0.8 g of potassium iodide so as to increase the volume to 97.4 ml, at a constant flow rate over 45 seconds. Thereafter, 10 ml of 3.5 mass % aqueous hydrogen peroxide solution and further 10.8 ml of 10 mass % aqueous benzimidazole solution were added to this mixture. Furthermore, thereto were added a solution C, in which distilled water had been added to 51.86 g of silver nitrate to increase the volume to 317.5 ml, and a solution D, in which distilled water had been added to 44.2 of potassium bromide and 2.2 of potassium iodide so as to increase the volume to 400 ml. All of the solution C was added at a constant flow rate over 20 minutes, and the solution D was added by a controlled double jet method while the pAg was kept at 8.1. All of a potassium salt of hexachloroiridate (III) was added to the solution such that the amount of the potassium salt was $1\times10^{-4}$ mole per mole of silver 10 minutes after starting to add the solutions C and D. 5 seconds after completing the addition of the solution C, all of an aqueous iron (II) potassium hexacyanide solution was added to the above-mentioned solution at a rate of $3\times10^{-4}$ mole per mole of silver. Sulfuric acid having a concentration of 0.5 mole/L was used to adjust the pH of the solution to 3.8, and then stirring was stopped. Then, precipitating, desalting, and water washing steps were performed. Sodium hydroxide having a concentration of 1 mole/L was used to adjust the pH to 5.9. In this way, a silver halide dispersion having a pAg of 8.0 was prepared.

While the silver halide dispersion was stirred, the temperature thereof was kept at 38° C. Thereto was added 5 ml of a 0.34% mass solution of 1,2-benzoisothiazoline-3-one in methanol. After 40 minutes, thereto was added a solution of a spectrally sensitizing dye A and a spectrally sensitizing dye B (molar ratio=1:1) in methanol in such a manner that the total amount of the dyes A and B would be $1.2\times10^{-3}$ mole per mole of silver. After one minute, the temperature of the solution was raised to 47° C. After 20 minutes from the rise in the temperature, to the solution was added a solution of sodium benzenethiosulfonate in methanol in an amount of $7.6\times10^{-5}$ mole per mole of silver. After 5 minutes, to the solution was added a solution of a tellurium sensitizing agent C in methanol in amount of $2.9\times10^{-4}$ mole per mole of silver. The resultant solution was ripened for 91 minutes. Thereto was added 1.3 ml of a 0.8 mass % solution of N,N'-dihydroxy-N"-diethylmelamine in methanol, and after 4 minutes thereto was further added a solution of 5-methyl-2-mercaptobenzimidazole in methanol in an amount of $4.8\times10^{-3}$ mole per mole of silver and added a solution of 1-phenyl-2-heptyl-5-mercapto-1,3,4-triazole in methanol in an amount of $5.4\times10^{-3}$ mole per mole of silver. In this way, a silver halide emulsion-1 was prepared.

Grains of the prepared silver halide emulsion were silver iodobromide uniformly containing 3.5% by mole of iodine whose average sphere equivalent diameter was 0.042 μm and whose variation coefficient of the sphere equivalent diameter was 20%. The grain size and the like were calculated as an average value of 1000 grains, using an electron microscope. The {100} plane ratio of the grains was 80% according to Kubelka-Munk process.

<<Preparation of a Silver Halide Emulsion-2>>

A silver halide emulsion-2 was prepared in the same way as in the preparation of the silver halide emulsion-1 except that the solution temperature at the time of the formation of the grains was changed from 30° C. to 47° C., the solution B was changed to a solution wherein distilled water was added to 15.9 g of potassium bromide so as to increase the volume to 97.4 ml, the solution D was changed to a solution wherein distilled water was added to 45.8 g of potassium bromide so as to increase the volume to 400 ml, the time of adding the solution C was changed to 30 minutes, and iron (II) potassium hexacyanide was removed. In the same way as in the case of the silver halide emulsion-1, precipitation, desalting, water washing and dispersion were performed. In the same way as in the case of the silver halide emulsion-1, spectral sensitization, chemical sensitization and the addition of 5-methyl-2-mercaptobenzimidazole and 1-phenyl-2-heptyl-5-mercapto-1,3,4-triazole were performed except that the adding amount of the solution of the spectrally sensitizing dye A and the spectrally sensitizing dye B (molar ratio=1:1) in methanol was changed to $7.5\times10^{-4}$ mole as a total amount of the two dyes per mole of silver, the adding amount of the tellurium sensitizer C was changed to $1.1\times10^{-4}$ mole per mole of silver, and the amount of 1-phenyl-2-heptyl-5-mercapto-1,3,4-triazole was changed to $3.3\times10^{-3}$ per mole of silver. In this way, a silver halide emulsion-2 was prepared. The emulsion grains of the silver halide emulsion-2 were pure silver bromide cubic grains whose average sphere equivalent diameter was 0.080 μm and whose variation coefficient of the sphere equivalent diameter was 20%.

<<Preparation of a Silver Halide Emulsion-3>>

A silver halide emulsion-3 was prepared in the same way as in the preparation of the silver halide emulsion-1 except that the solution temperature at the time of the formation of the grains was changed from 30° C. to 27° C. In the same way as in the case of the silver halide emulsion-1, precipitation, desalting, water washing and dispersion were performed. In the same way as in the case of the silver halide emulsion-1, the silver halide emulsion-3 was obtained except that the adding amount of the solid dispersion (aqueous gelatin solution) of the spectrally sensitizing dye A and the spectrally sensitizing dye B (molar ratio=1:1) was changed to $6\times10^{-3}$ mole as a total amount of the two dyes per mole of silver and the adding amount of the tellurium sensitizer C was changed to $5.2\times10^{-4}$ mole per mole of silver. The emulsion grains of the silver halide emulsion-3 were silver iodobromide grains uniformly containing 3.5% by mole of iodine whose average sphere equivalent diameter was 0.034 μm and whose variation coefficient of the sphere equivalent diameter was 20%.

<<Preparation of a Silver Halide Mixture Emulsion A for a Coating Solution>>

70 mass % of the silver halide emulsion-1, 15 mass % of the silver halide emulsion-2 and 15 mass % of the silver halide emulsion-3 were mixed with each other and melted. Thereto was added a 1 mass % solution of benzothiazolium iodide in water in an amount of $7\times10^{-3}$ mole per mole silver. Furthermore, water was added thereto such that the content of silver of the silver halide was 38.2 g per kg of the silver halide mixture emulsion for a coating solution.

<<Preparation of an Organic Silver Salt Dispersion>>

The following were mixed: 87.6 kg of behenic acid (trade name; Edenor c22-85R) made by Henckel Co., 423 L of distilled water, 49.2 L of an 5 mol/L aqueous NaOH solution, and 120 L of tert-butanol. The mixture was stirred at 75° C. for 1 hour to advance reaction. In this way, a sodium behenate solution was yielded. Separately, 206.2 L (pH: 4.0) of an aqueous solution of 40.4 kg silver nitrate was prepared, and the temperature of the solution was kept at 10° C. A reaction container in which 635 L of distilled water and 30 L of tert-butanol were put was kept at 30° C. While the solution was sufficiently stirred, thereto were added all amount of the sodium behenate solution and all amount of the aqueous silver nitrate solution at constant flow rates over 93 minutes 15 seconds and 90 minutes, respectively. In this case, for 11 minutes after the start of the addition of the aqueous silver nitrate solution, only the aqueous silver nitrate solution was added. Thereafter, the addition of the sodium behenate solution was started. For 14 minutes 15 seconds after the end of the addition of the aqueous silver nitrate solution, only the sodium behenate solution was added. At this time, the temperature of the reaction container was set to 30° C., and external temperature was controlled to make the temperature of the solution constant. Laying pipes of the sodium behenate adding system were kept warm by circulating hot water to the outside of its double pipes, and the solution temperature of an outlet made at the tip of an adding nozzle was adjusted to 75° C. Laying piles of the adding system of the aqueous silver nitrate solution were kept cool by circulating cool water to the outside of its double pipes. Positions where the sodium behenate solution and the aqueous silver nitrate solution were added were set to be symmetrical around a stirring axis as a center. The positions were also adjusted not to contact the reaction solution.

After the end of the addition of the sodium behenate solution, the reaction system was stirred for 20 minutes while the temperature thereof was kept as it was and allowed to stand. The temperature of the system was raised to 35° C. over 30 minutes. Thereafter, the reaction system was ripened for 210 minutes. Immediately after the end of the ripening, a solid was collected by centrifugal filtration, and then the solid was washed with water until the electroconductivity of filtrated water was 30 μS/cm. In this way, an organic silver salt was yielded. The resultant solid was stored as a wet cake without being dried.

The form of the resultant silver behenate grains was observed with an electron microscope. As a result, the grains were in the form of a scaly crystal having a of 0.14 μm, b of 0.4 μm, c of 0.6 μm, an average aspect ratio of 5.2, an average sphere equivalent diameter of 0.52 μm, and a variation coefficient of the sphere equivalent diameter of 15% (a, b and c were defined above).

19.3 kg of polyvinyl alcohol (trade name: PVA-217), and water were added to the wet cake corresponding to a dry solid content of 260 kg in order to increase the total volume to 1000 kg. The resultant was turned to a slurry by means of dissolver fins, and further the slurry was pre-dispersed with a pipe line mixer (PM-10 type, made by Mizuho Kogyo Co.)

Next, the pre-dispersed stock solution was subjected to dispersion treatment 3 times with a dispersing machine (trade name: Microfluidizer M-610 using a Z type interaction chamber, made by Microfluidex International Corporation) at a pressure adjusted to 1260 kg/cm$^2$ (12.6 MPa). In this way, a silver behenate dispersion was yielded. About cooling operation, a flexible tube type heat exchanger was set to the front and rear of the interaction chamber, and dispersion temperature was set to 18° C. by adjusting the temperature of a coolant.

<<Preparation of a Reducing Agent-1 Dispersion>>

16 kg of water was added to 10 kg of a reducing agent-1 (1,1-bis(2-hydroxy-3,5-dimethylphenyl)-3,5,5-trimethylhexane) and 10 kg of a 20 mass % aqueous solution of a modified polyvinyl alcohol (Poval MP203, made by Kuraray Co., Ltd.), and the resultant was sufficiently stirred to prepare a slurry. This slurry was sent to a lateral type sand mill (UVM-2, made by I.mecs), filled with zirconia beads having an average diameter of 0.5 mm, by means of a diaphragm pump, and dispersed therein for 3 hours 30 minutes. Thereafter, 0.2 g of a sodium salt of benzoisothiazolinone and water were added to the slurry, to set the concentration of the reducing agent to 25 mass %. In this way, a reducing agent-1 dispersion was prepared. Reducing agent grains contained in the thus obtained reducing agent-1 dispersion had a median diameter of 0.42 μm and a maximum grain diameter of 2.0 μm or less. The resultant reducing agent-1 dispersion was filtrated with a filter made of polypropylene and having a pore diameter of 10.0 μm, to remove foreign matters such as dusts, and was stored.

<<Preparation of a Reducing Agent-2 Dispersion>>

16 kg of water was added to 10 kg of a reducing agent-2 (2,2'-isobutylidene-bis-(4,6-dimethylphenol)) and 10 kg of a 20 mass % aqueous solution of a modified polyvinyl alcohol (Poval MP203, made by Kuraray Co., Ltd.), and the resultant was sufficiently mixed to prepare a slurry. This slurry was sent to a lateral type sand mill (UVM-2, made by I.mecs), filled with zirconia beads having an average diameter of 0.5 mm, by means of a diaphragm pump, and dispersed therein for 3 hours 30 minutes. Thereafter, 0.2 g of a sodium salt of benzoisothiazolinone and water were added to the slurry, to make the concentration of the reducing agent to 25 mass %. In this way, a reducing agent-2 dispersion was prepared. Reducing agent grains contained in the thus obtained reducing agent-2 dispersion had a median diameter of 0.38 μm and a maximum grain diameter of 2.0 μm or less. The resultant reducing agent-2 dispersion was filtrated with a filter made of polypropylene and having a pore diameter of 10.0 μm, to remove foreign matters such as dusts, and was stored.

<<Preparation of an Organic Polyhalogen Compound-1 Dispersion>>

The following were sufficiently mixed to prepare a slurry: 10 kg of an organic polyhalogen compound-1 (2-tribromomethanesulfonylnaphthalene), 10 kg of a 20 mass % aqueous solution of a modified polyvinyl alcohol (Poval MP203, made by Kuraray Co., Ltd.), 0.4 kg of a 20 mass % aqueous solution of sodium triisopropylnaphthalenesulfonate, and 16 kg of water. This slurry was sent to a lateral type sand mill (UVM-2, made by I.mecs), filled with zirconia beads having an average diameter of 0.5 mm, by means of a diaphragm pump, and dispersed therein for 5 hours. Subsequently, thereto were added 0.2 g of a sodium salt of benzoisothiazolinone and water, to adjust the concentration of the organic polyhalogen compound to 23.5 mass %. In this way, an organic polyhalogen compound-1 dispersion was obtained. Organic polyhalogen compound grains contained in the thus obtained organic polyhalogen compound-1 dispersion had a median diameter of 0.36 μm and a maximum grain diameter of 2.0 μm or less. The resultant organic polyhalogen compound-1 dispersion was filtrated with a filter made of polypropylene and having a pore diameter of 10.0 μm, to remove foreign matters such as dusts, and was stored.

<<Preparation of an Organic Polyhalogen Compound-2 Dispersion>>

The following were sufficiently mixed to prepare a slurry: 10 kg of an organic polyhalogen compound-2 (tribromomethanesulfonylbenzene), 10 kg of a 20 mass % aqueous solution of a modified polyvinyl alcohol (Poval MP203, made by Kuraray Co., Ltd.), 0.4 kg of a 20 mass % aqueous solution of sodium triisopropylnaphthalenesulfonate, and 14 kg of water. This slurry was sent to a lateral type sand mill (UVM-2, made by I.mecs), filled with zirconia beads having an average diameter of 0.5 mm, by means of a diaphragm pump, and dispersed therein for 5 hours. Subsequently, thereto were added 0.2 g of a sodium salt of benzoisothiazolinone and water, to adjust the concentration of the organic polyhalogen compound to 26 mass %. In this way, an organic polyhalogen compound-2 dispersion was obtained. Organic polyhalogen compound grains contained in the thus obtained organic polyhalogen compound-2 dispersion had a median diameter of 0.41 μm and a maximum grain diameter of 2.0 μm or less. The resultant organic polyhalogen compound-2 dispersion was filtrated with a filter made of polypropylene and having a pore diameter of 10.0 μm, to remove foreign matters such as dusts, and was stored.

<<Preparation of a Phthalazine-1 Solution>>

8 kg of modified polyvinyl alcohol (MP203, made by Kuraray Co., Ltd.) was dissolved in 174.57 kg of water. Next, thereto were added 3.15 kg of a 20 mass % aqueous solution of sodium triisopropylnaphthalenesulfonate and 14.28 kg of a 70 mass % aqueous solution of a phthalazine compound-1 (6-isopropylphthalazine), to prepare a 5 mass % solution of the phthalazine compound-1.

<<Preparation of an Aqueous Mercapto Compound-1 Solution>>

7 g of a mercapto compound-1 (a sodium salt of 1-(3-sulfophenyl)-5-mercaptotetrazole)was dissolved in 993 g of water to prepare a 0.7 mass % aqueous solution of the compound.

<<Preparation of a Pigment-1 Dispersion>>

250 g of water was added to 64 g of C. I. Pigment Blue 60 and 6.4g of Demol N made by Kao Corporation, and the resultant was sufficiently mixed to prepare a slurry. 800 g of zirconia beads having an average diameter of 0.5 mm were prepared. The beads and the slurry were put into a vessel, and they were dispersed in a dispersing machine (¼ G sand grinder mill, made by I.mecs) for 25 hours, to obtain a pigment-1 dispersion. Pigment grains contained in the thus obtained pigment-1 dispersion had an average grain size of 0.21 μm.

<<Preparation of an SBR Latex Emulstion>>

An SBR latex having a Tg of 23° C. was prepared as follows.

Ammonium persulfate as a polymerization initiator and an anionic surfactant as an emulsifier were used to emulsion-polymerize 70.5 parts by mass of styrene, 26.5 parts by mass of butadiene, and 3 parts by mass of acrylic acid. Thereafter, the resultant was subjected to aging at 80° C. for 8 hours, and then cooled to 40° C. The pH of the emulsion was adjusted to 7.0 with ammonia water, and thereto was added Sandett BL made by Sanyo Chemicals Industries, Ltd. so that the concentration thereof was 0.22%. Next, thereto was added a 5% aqueous sodium hydroxide solution to adjust the pH of the emulsion solution to 8.3. Furthermore, the pH of the emulsion was adjusted to 8.4 with ammonia water. The molar ratio between $Na^+$ ions and $NH_4^+$ ions used at this time was 1:2.3. Furthermore, 0.15 ml of a 7% aqueous solution of a sodium salt of benzoisothiazolinone was added to 1 kg of this emulsion to prepare an SBR latex emulsion. (SBR latex: a latex of -St(70.5)-Bu(26.5)-AA(3)-)

Tg: 23° C., average grain size: 0.1 μm, concentration: 43 mass %, equilibrium moisture content at 25° C. and 60% RH: 0.6 mass %, ion conductivity: 4.2 mS/cm (a conductivity meter CM-30S made by DKK-TOA Corporation was used to measure the ion conductivity of the latex undiluted solution (43 mass %) at 25° C.), and pH: 8.4.

SBR latexes having different Tg's were prepared in the same manner except that the ratio between styrene and butadiene was appropriately changed.

<<Preparation of an Emulsion Layer (Photosensitive Layer) Coating Solution>>

To 1000 g of the organic silver salt dispersion obtained in the above-mentioned steps were successively added 125 ml of water, 113 g of the reducing agent-1 dispersion, 91 g of the reducing agent-2 dispersion, 27 g of the pigment-1 dispersion, 82 g of the organic polyhalogen compound-1 dispersion, 40 g of the organic polyhalogen compound-2 dispersion, 173 g of the phthalazine compound-1 solution, 1082 g of the SBR latex (Tg: 20.5° C.) emulsion, and 9 g of the aqueous mercapto compound-1 solution. Immediately before coating, thereto was added 158g of the silver halide mixed emulsion A for a coating solution, and the emulsion layer coating solution sufficiently mixed was sent to a coating die, and applied.

The viscosity of the emulsion layer coating solution was measured with a B type viscometer made of Tokyo Keiki Co. As a result, the viscosity was 85 mPa.s at 40° C. (No. 1 rotor, 60 rpm).

According to an RFS fluid spectrometer made by Leometrics Far East Co., Ltd, the viscosities of the coating solution at 25° C. were 1500, 220, 70, 40 and 20 mpa.s at shear speeds of 0.1, 1, 10, 100 and 1000 1/sec., respectively.

<<Preparation of Emulsion-face Intermediate Layer Coating Solution>>

To 772 g of a 10 mass % aqueous solution of polyvinyl alcohol PVA-205 (made by Kuraray Co., Ltd.), 5.3 g of a 20 mass % dispersion of a pigment, and 226 g of a 27.5 mass % latex emulsion of methyl methacrylate/styrene/butyl acrylate/hydroxyethyl methacrylate/acrylic acid copolymer (weight ratio: 64/9/20/5/2) were added 2 ml of a 5 mass % aqueous solution of Aerosol OT (made by American Sianamide Co.) and 10.5 ml of a 20 mass % aqueous solution of diammonium phthalate. Furthermore, water was added thereto so that the total amount was 880 g. The pH of the solution was adjusted to 7.5 with NaOH to prepare an intermediate layer coating solution. The solution was sent to a coating die to produce a coating amount of 10 ml/$m^2$.

The viscosity of the coating solution was 21 mpa.s at 40° C. according to the B type viscometer (No. 1 rotor, 60 rpm).

<<Preparation of Emulsion-face First Protective Layer Coating Solution>>

Into water was dissolved 64 g of inert gelatin, and thereto were added 80 g of a 27.5 mass % latex solution of methyl methacrylate/styrene/butyl acrylate/hydroxyethyl methacrylate/acrylic acid copolymer (weight ratio: 64/9/20/5/2), 23 ml of a 10 mass % solution of phthalic acid in methanol, 23 ml of a 10 mass % solution of 4-methylphthalic acid, 28 ml of sulfuric acid having a concentration of 0.5 mole/L, 5 ml of a 5 mass % aqueous solution of Aerosol OT (made by American Sianamide Co.), 0.5 g of phenoxyethanol, and 0.1 g of benzoisothiazolinone. Water was added thereto so that the total amount was 750 g. In this way, a coating solution was prepared. Immediately before coating, 26 ml of 4 mass % chrome alum was mixed with the coating solution with a static mixer. The mixture was sent to a coating die to produce a coating amount of 18.6 ml/$m^2$.

The viscosity of the coating solution was 17 mPa.s at 40° C. according to the B type viscometer (No. 1 rotor, 60 rpm).

<<Preparation of Emulsion-face Second Protective Layer Coating Solution>>

Into water was dissolved 80 g of inert gelatin, and thereto were added 102 g of a 27.5 mass % latex solution of methyl methacrylate/styrene/butyl acrylate/hydroxyethyl methacrylate/acrylic acid copolymer (weight ratio: 64/9/20/5/2), 3.2 ml of a 5 mass % solution of a fluorine-containing surfactant (F-1: a potassium salt of N-perfluorooctylsulfonyl-N-propylalanine, 32 ml of a 2 mass % aqueous solution of a fluorine-containing surfactant (F-2: polyethyleneglycol mono(N-perfluorooctylsulfonyl-N-propyl-2-aminoethyl) ether [ethylene oxide average polymerization degree=15], 23 ml of a 5 mass % aqueous solution of Aerosol OT (made by American Sianamide Co.), 4 g of polymethyl methacrylate fine grains (average grain size: 0.7 μm), 21 g of polymethyl methacrylate fine grains (average grain size: 4.5 μm), 1.6 g of 4-methylphthalic acid, 4.8 g of phthalic acid, 44 ml of sulfuric acid having a concentration of 0.5 mole/L, and 10 mg of benzoisothiazolinone. Water was added thereto so that the total amount was 650 g. Immediately before coating, 445 ml of an aqueous solution containing 4 mass % chrome alum and 0.67 mass % of phthalic acid were mixed with the coating solution with a static mixer. The mixture was used as a surface protective layer coating solution and sent to a coating die to produce a coating amount of 8.3 ml/$m^2$.

The viscosity of the coating solution was 9 mPa.s at 40° C. according to the B type viscometer (No. 1 rotor, 60 rpm).

<<Production of Heat-developable Photosensitive Materials-1 to 5>>

While the wound undercoat substrates A to E were conveyed, the antihalation layer coating solution and the back face protective layer coating solution were simultaneously applied, in the form of overlapped layers, to the back face of each of the substrates. The antihalation layer coating solution was applied so that the solid content coating amount of the solid fine grain dye was 0.04 g/$m^2$, and the back face protective layer coating solution was applied so that the gelatin coating amount was 1.7 g/$m^2$. The applied solutions were dried to produce a back layer.

The emulsion layer (photosensitive layer) coating solution, the intermediate coating solution, the first protective layer coating solution and the second protective layer coating solution were simultaneously applied, in this order when viewed from the undercoat layer face and in the form of overlapped layers, to the face opposite to the back face in a slide bead coating manner. In this way, a long heat-developable photosensitive materials-1 to -5 were produced. At this time, the temperature of the emulsion layer and the intermediate layer was adjusted to 31° C., the temperature of the first protective layer was adjusted to 36° C., and the temperature of the second protective layer was adjusted to 37° C.

The coating amounts ($g/m^2$) of the respective compounds in the emulsion layers were as follows.

| | |
|---|---|
| silver behenate (organic silver salt) | 6.19 |
| reducing agent-1 | 0.67 |
| reducing agent-2 | 0.54 |
| pigment (C. I. Pigment blue 60) | 0.032 |
| organic polyhalogen compound-1 | 0.46 |
| organic polyhalogen compound-2 | 0.25 |
| phthalazine compound-1 | 0.21 |
| SBR latex | 11.1 |
| mercapto compound-1 | 0.002 |
| silver halide (as Ag) | 0.145 |

Coating and dry conditions were as follows.

The coating was performed at a speed of 160 m/min. A gap between the tip of the coating die and the substrate was set to 0.10 to 0.30 mm. A pressure in a reducing chamber was set to be from 196 to 882 Pa lower than the atmospheric pressure. The substrate was subjected to electricity-removing treatment by ion-wind before coating.

Subsequently, in a chilling zone, the coating solution was cooled with wind having a dry bulb temperature of 10 to 20° C. Thereafter, the substrate was conveyed in a non-contacting manner, and dried by dry wind having a dry bulb temperature of 23 to 45° C. and a wet bulb temperature of 15 to 21° C. in a tendril type non-contact drying machine.

After the drying, the humidity was adjusted to 40 to 60% RH at 25° C. Thereafter, the substrate was heated so that the temperature of its film face was from 70 to 90° C. After the heating, the film face was cooled to 25° C.

About the mat degree of the produced heat-developable photosensitive material, the Beck smoothness thereof was 550 seconds on the side of the photosensitive layer face, and was 130 seconds on the side of the back face. The pH of the film face on the side of the photosensitive layer was measured. As a result, the pH was 6.0.

Chemical structures of the compounds used in the examples of the invention will be illustrated below.

Spectrally sensitizing dye A

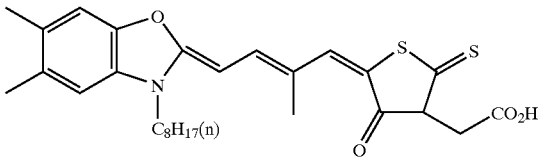

Spectrally sensitizing dye B

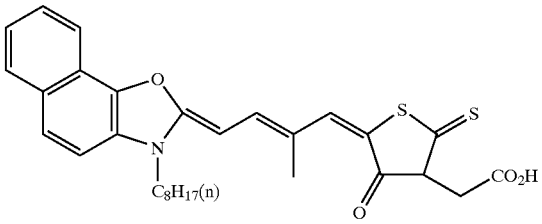

-continued

Tellurium sensitizer C

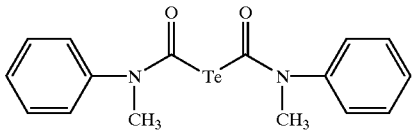

Base precursor compound 11

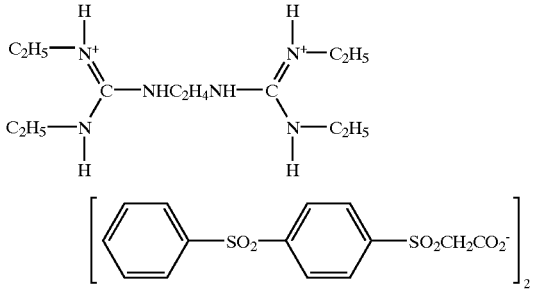

Cyanine dye compound 13

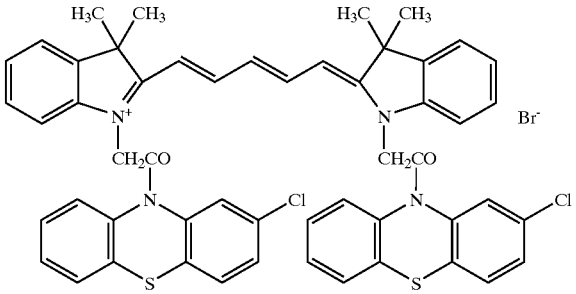

Blue dye compound 14

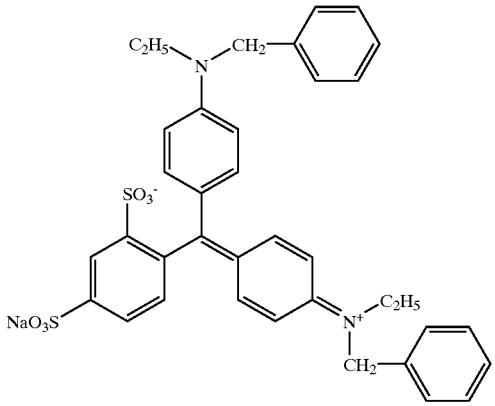

Yellow dye compound 15

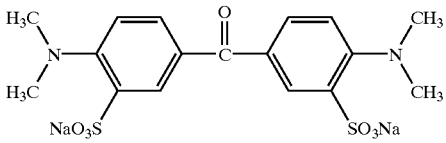

-continued

Reducing agent-1

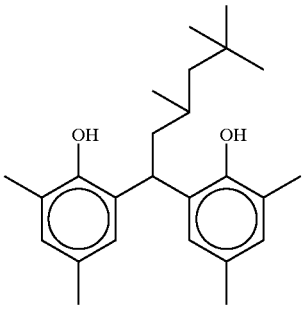

Reducing agent-2

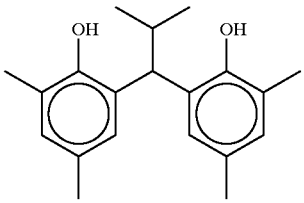

Organic polyhalogen compound-1

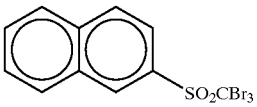

Organic polyhalogen compound-2

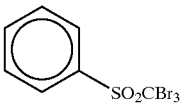

Phthalazine compound-1

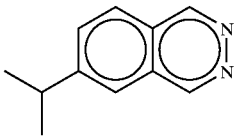

Mercapto compound-1

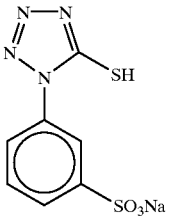

-continued

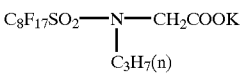

(F-1)

n = 15 (average)

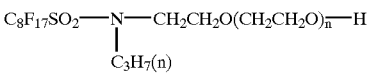

(F-2)

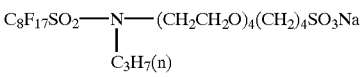

(F-3)

(Evaluation)

Photosensitive materials were produced in the same way in the production of the heat-developable photosensitive materials-1 to -5 except that the intermediate layer and the protective layer were not formed. About these photosensitive materials, the following evaluations were made. The results are shown in Table 1.

Defect Generation Rate

The photosensitive layers in the resultant long heat-developable photosensitive materials were observed, and cases in which one or more cissing defects or streaking defects per 15 $m^2$ were found were counted, and then the defect generation rate thereof was obtained.

Presence or Absence of Wrinkles

The photosensitive layers in the resultant long heat-developable photosensitive materials were observed to examine whether wrinkles were generated or not.

TABLE 1

| | Adhesive roll | | | Photosensitive layer | | |
|---|---|---|---|---|---|---|
| Photosensitive material | Kind | Hardness (·) | Adhesive force (hPa) | Defect generation rate (%) | Wrinkles | Notes |
| 1 | None | — | — | 30 | Not generated | Comparative Example |
| 2 | MT | 30 | 35 | 25 | Not generated | The invention |
| 3 | ST | 25 | 73 | 23 | Not generated | The invention |

TABLE 1-continued

| | Adhesive roll | | | Photosensitive layer | | |
|---|---|---|---|---|---|---|
| Photosensitive material | Kind | Hardness (·) | Adhesive force (hPa) | Defect generation rate (%) | Wrinkles | Notes |
| 4 | GT | 15 | 135 | 12 | Not generated | The invention |
| 5 | SGT | 8 | 200 | 10 | Slightly generated | The invention |

MT: "MIOSA MT" Miyagawa Roll K.K.
ST: "MIOSA ST" Miyagawa Roll K.K.
GT: "MIOSA GT" Miyagawa Roll K.K.
SGT: "MIOSA SGT" Miyagawa Roll K.K.

It can be understood from the result shown in Table 1 that in each of the photosensitive materials from which foreign matters were removed with the adhesive roll having an adhesive force of 35 hPa or more, a good photosensitive layer was formed. It can also be understood from this fact that the undercoat layer was satisfactorily formed and the photosensitive layer was formed in the state that the amount of foreign matters adhering to the undercoat layer was slight.

Each of the resultant heat-developable photosensitive materials-1 to -5 was used to form an image. As a result, good images were obtained about the heat-developable photosensitive materials-2 to -5. However, about the heat-developable photosensitive material-1, image defects based on the various defects in the photosensitive layer were generated.

What is claimed is:

1. A method of producing a heat-developable photosensitive material, which comprises a substrate having a front face and a back face, an undercoat layer, and a photosensitive layer containing silver behenate disposed on the substrate in this order on said front or back face of said substrate, said heat-developable photosensitive material further comprising light sensitive silver halide and reducing agent for silver halide, the method comprising the step of:

contacting an adhesive roll having an adhesive force of at least 35 hPa with said front or back face of the substrate or with the undercoat layer of the photosensitive material before forming the photosensitive layer thereon.

2. The method of producing the heat-developable photosensitive material of claim 1, wherein a contact speed of the adhesive roll is from 30 to 200 m/min.

3. The method of producing the heat-developable photosensitive material of claim 1, wherein a contact angle between the adhesive roll and the photosensitive material is from 0 to 120°.

4. The method of producing the heat-developable photosensitive material of claim 1, wherein the adhesive roll is brought into contact with said front or back face of the substrate or with the undercoat layer of the photosensitive material in an atmosphere having a temperature of 10 to 60° C. and a humidity of 30 to 90%.

5. The method of producing the heat-developable photosensitive material of claim 1, wherein the adhesive roll is brought into contact with said front or back face of the substrate or with the undercoat layer of the photosensitive material in an atmosphere having a cleanliness class of no more than M5.5.

* * * * *